US005449120A

United States Patent [19]

Tani et al.

[11] Patent Number: 5,449,120

[45] Date of Patent: Sep. 12, 1995

[54] FUEL FEED APPARATUS OF INTERNAL COMBUSTION ENGINE

[75] Inventors: Yasuhide Tani, Nagoya; Kiyoshi Nagata, Anjo; Yoshihiko Ito, Aichi, all of Japan

[73] Assignee: Nippondenso Co., Ltd., Kariya, Japan

[21] Appl. No.: 165,310

[22] Filed: Dec. 13, 1993

Related U.S. Application Data

[60] Continuation-in-part of Ser. No. 35,214, Mar. 22, 1993, Pat. No. 5,358,181, which is a division of Ser. No. 896,036, Jun. 9, 1992, Pat. No. 5,211,682.

[30] Foreign Application Priority Data

Jun. 11, 1991 [JP] Japan ..... 3-139251
Apr. 8, 1992 [JP] Japan ..... 4-87172
Feb. 26, 1993 [JP] Japan ..... 5-038104

[51] Int. Cl.[6] ..... F02M 43/04

[52] U.S. Cl. ..... 239/397.5; 239/409; 239/417.3; 239/585.5; 239/600; 239/DIG. 19; 123/531

[58] Field of Search ..... 239/397.5, 408, 409, 239/417.3, 422, 424.5, 533.2, 533.12, 584, 585.1, 585.4, 585.5, 600, DIG. 19; 123/531

[56] References Cited

U.S. PATENT DOCUMENTS

| | | | |
|---|---|---|---|
| 3,680,794 | 8/1972 | Romann et al. | 239/585.5 X |
| 3,782,639 | 1/1974 | Boltz et al. | 239/585.5 X |
| 4,557,874 | 12/1985 | Neumann et al. | 239/585.1 X |
| 4,676,216 | 6/1987 | Ohsawa et al. | 239/585.5 X |
| 4,890,594 | 1/1990 | Duret . | |
| 4,917,307 | 4/1990 | Baxter et al. | 239/533.2 X |
| 4,945,877 | 8/1990 | Ziegler et al. . | |
| 4,957,241 | 9/1990 | Roger | 239/409 |
| 4,979,479 | 12/1990 | Furukawa . | |
| 4,982,716 | 1/1991 | Takeda et al. . | |
| 5,024,201 | 6/1991 | Kobayashi . | |
| 5,027,778 | 7/1991 | Nogi et al. . | |
| 5,035,358 | 7/1991 | Katsuno et al. | 239/409 X |
| 5,046,472 | 9/1991 | Linder . | |
| 5,054,457 | 10/1991 | Sakamoto . | |
| 5,088,650 | 2/1992 | Takagi et al. | 239/584 X |
| 5,129,381 | 7/1992 | Nakajima | 239/533.12 X |
| 5,156,133 | 10/1992 | Sugimoto . | |
| 5,193,743 | 3/1993 | Romann et al. | 239/409 X |
| 5,197,672 | 3/1993 | Grytz et al. | 239/409 X |
| 5,207,383 | 5/1993 | Hans et al. | 239/409 |
| 5,220,900 | 6/1993 | Wakeman . | |
| 5,232,163 | 8/1993 | Grytz | 239/424.5 X |
| 5,358,181 | 10/1994 | Tani et al. | 239/409 |

FOREIGN PATENT DOCUMENTS

| | | |
|---|---|---|
| 59-043962 | 3/1984 | Japan . |
| 61-226563 | 10/1986 | Japan . |
| 63-314363 | 12/1988 | Japan . |
| 64-024161 | 1/1989 | Japan . |
| 1100368 | 4/1989 | Japan . |
| 2016057 | 5/1990 | Japan . |
| 2136560 | 5/1990 | Japan . |
| 3237263 | 10/1991 | Japan . |

*Primary Examiner*—William Grant
*Attorney, Agent, or Firm*—Cushman, Darby & Cushman

[57] ABSTRACT

A fuel feed apparatus having assist air passages that improve the fuel flow to an internal combustion engine. The fuel feed apparatus includes a fuel injection valve having a fuel injection nozzle body, and a resin cover member having both a fuel passage and an air assist passage. The cover member is press fit to the fuel injection body. The fuel feed apparatus further includes a ring member formed of metallic material and attached to an inner surface of the cover member.

6 Claims, 17 Drawing Sheets

FUEL FEED APPARATUS OF INTERNAL COMBUSTION ENGINE

This is a continuation-in-part of application Ser. No. 08/035,214, filed on Mar. 22, 1993, now U.S. Pat. No. 5,358,181, which is a divisional of application Ser. No. 07/896,036, filed on Jun. 9, 1992, now U.S. Pat. No. 5,211,682.

BACKGROUND OF THE INVENTION

This invention relates to a fuel feed apparatus which feeds fuel to an internal combustion engine, and more particularly, to a fuel feed apparatus which is capable of promoting atomization of the fuel by supplying assist air to a fuel injection valve disposed in an intake passage of the internal combustion engine and serving to inject the fuel.

Heretofore, an internal combustion engine of the type that one cylinder is provided with a plurality of intake valves has been put into practice widely.

Further, there has been well known a fuel injection valve of the type that a plurality of fuel injection nozzles are directed to a plurality of intake valves individually so as to inject the fuel toward the intake valves to thereby reduce fuel adhesion to the intake passage and hence improve the performance of the engine.

In addition, there has been well known such a technique named air assist that air is injected from the fuel injection valve together with the fuel. For example, as disclosed in Japanese Utility Model Examined Publication No. 2-16057, it has been known as well that assist air is supplied to a fuel injection valve having two fuel injection nozzles so as to atomize the fuel sprayed for two intake valves by the assist air. Moreover, in the fuel injection valve disclosed in Japanese Patent Unexamined Publication No. 64-24161 as well, assist air is supplied to the fuel injection valve having two fuel nozzles so as to atomize the fuel sprayed for two intake valves by the assist air.

According to these air assist techniques, since the fuel can be atomized by the assist air, combustion can be improved and hence the constituents of exhaust gas can be improved. Still furthermore, Japanese Patent Unexamined Publication No. 63-314363 discloses a technique that a sleeve to be provided at the tip end of the fuel injection valve is divided into two parts so as to form assist air passages in abutting surfaces of the two sleeve members.

According to the conventional air assist technique described above, the assist air is supplied to two sprays of fuel directed to two intake valves individually so as to form two separate sprays of fuel atomized by the assist air. However, in case of atomizing the fuel due to air assist, since the assist air is made to collide against the sprayed fuel, as the particle size of the air-assisted sprayed fuel becomes smaller to promote the atomization, the spray cone angle of the air-assisted sprayed fuel becomes larger. For this reason, if it is intended to form two air-assisted sprays as in the conventional air assist technique, it is necessary to make small the spray cone angle of each spray, resulting in the problem that the atomization cannot be performed satisfactorily.

In consequence, according to the conventional air assist technique, it is impossible to perform the atomization satisfactorily, resulting in the problem that the fuel adheres to the intake passage or the intake valves.

Particularly when it is required to inject a large amount of fuel such as when the internal combustion engine is operated in high-load condition or operated at low temperatures immediately after the engine is started, the fuel injection time of the fuel injection valve is prolonged in order to increase the fuel injection amount so that the fuel injection is started before the intake valves are opened in some cases. If the fuel is injected at the time when the intake air flows slow, such as before the intake valves are opened, according to the conventional air assist technique, a large amount of fuel adheres to the intake passages or the intake valves, thereby making it impossible to improve the combustion in the cylinder sufficiently and hence to improve the constituents of the exhaust gas satisfactorily.

Further, according to the conventional air assist technique, forming of the assist air passages requires drilling of elongated holes, resulting in the problem that the manufacturing cost is increased. To cope with this, it is considered to form the assist air passages between the two members. However, in case that the two members are plasticized, there is a possibility that, in joining the two members to each other, the assist air passages are deformed due to crushing of the bonding agent, resin or the like to thereby cause the clogging of the assist air passages or the lack of assist air flow.

OBJECT AND SUMMARY OF THE INVENTION

An object of the present invention is to provide a fuel feed apparatus which is capable of actualizing an injection mode which forms sprays directed toward a plurality of intake valves and another injection mode which forms a single spray having a wide spray cone angle, while overcoming the above-described problems of the conventional air assist technique.

Another object of the present invention is to provide a method for manufacturing a fuel feed apparatus which is capable of forming assist air passages using a resin material without deforming the assist air passages.

According to the present invention, at the tip end of a fuel injection valve are provided a passage member which is formed with a fuel passage, assist air passages and a guide portion, and an interrupter means serving to interrupt the supply of assist air. The fuel passage is so formed as to direct the fuel injected from the fuel injection valve toward a plurality of intake valves of an internal combustion engine, while the assist air passages are so formed as to cross the fuel injected from the fuel passage. For this reason, as the supply of the assist air is cut off by the interrupter means, the fuel injected from the fuel injection valve is passed through the fuel passage so as to be injected toward the respective intake valves, thereby forming sprays directed toward a plurality of intake valves of the internal combustion engine. On the other hand, as the interrupter means allows the assist air to be supplied, the fuel issued from the fuel passage is stirred and atomized due to collision with the assist air so as to become a single spray. At this time, the spray cone angle becomes large due to collision with the assist air; however, it is regulated by the guide portion, thereby obtaining a spray of the desired spray cone angle. In this way, according to the present invention, it is possible to actualize an injection mode which forms sprays directed toward a plurality of intake valves and another injection mode which forms a single spray having a wide spray cone angle.

Further, the fuel passage can comprise a plurality of fuel passages directed to the plurality of intake valves.

This makes it possible to form a plurality of separate sprays directed toward the respective intake valves.

Moreover, the assist air passages are each formed to extend inwardly and inclinedly from the outside of the fuel passage toward the direction of fuel injection so that the spray cone angle can be prevented from becoming too large when the assist air is supplied.

Still furthermore, the assist air passages are so opened as to surround the opening of the fuel passage so that the spray cone angle can be prevented from becoming too large when the assist air is supplied.

According to the manufacturing method of the present invention, an inner member and an outer member which are formed with a fuel passage and assist air passages are formed using a resin material and, moreover, both are joined to each other to be unified. At this time, by inserting the inner member into the outer member through one of the openings thereof, the assist air passages are formed which extend from the penetrating holes passing through between the inner member and the outer member to reach around the fuel passage opened in the end surface of the inner member. Furthermore, the inner member and the outer member are joined to each other at a joining position nearer to one of the openings than the penetrating holes. Therefore, since no assist air passage is formed in the joining position, the assist air passages can be prevented from being deformed or clogged at the time of joining.

In addition, on the occasion of welding the inner member and the outer member to each other by melting part of both members as the inner member is inserted into the outer member, since the inner member is formed on the outer periphery thereof with a guide portion which is to be inserted as being kept in contact with the inner peripheral wall surface of the outer member, it is possible to weld both members to each other favorably due to melting of a melting portion and a stepped portion while maintaining a gap between the inner member and the outer member.

DESCRIPTION OF PREFERRED EMBODIMENTS

Preferred embodiments of the present invention will be described below.

Figure 1:
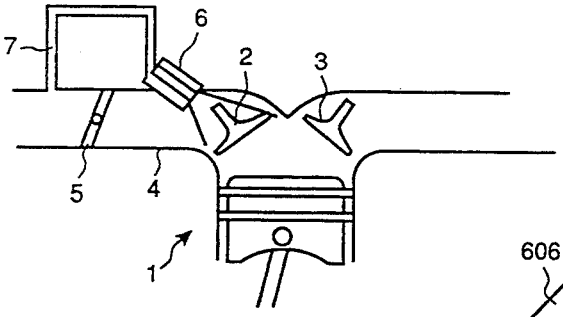
FIG. 1 is a structural view showing a schematic structure of a first embodiment of the present invention.

FIG. 1 is a structural view showing a schematic structure of a first embodiment.

In an internal combustion engine 1, each cylinder is provided with two intake valves 2 and two exhaust valves 3. In FIG. 1, one of the intake valves 2 and one of the exhaust valves 3 alone are illustrated. An intake passage 4 is connected to the intake valve 2 of the internal combustion engine, and a throttle valve 5 serving to regulate the intake air flow is disposed in the intake passage 4. Further, upstream of the intake passage 4 are provided an intake measuring device and an air cleaner which are not shown.

An air-assist fuel injection valve 6 is disposed between the throttle valve 5 and the intake valve 2 in the intake passage 4. The air-assist fuel injection valve 6 comprises a fuel injection nozzle through which the fuel is injected and an assist air jet nozzle through which assist air is jetted toward the fuel injected from the fuel injection nozzle. Further, the air-assist fuel injection valve 6 is fixed in the intake passage 4 so as to make the fuel injection nozzle thereof point at the intake valve 2. The air-assist fuel injection valve 6 is supplied with the fuel from a fuel tank which is not shown, which fuel is pressurized by a fuel pump and regulated at a fixed pressure by a pressure regulating valve, while a control pulse generated by a control unit which is not shown and having a pulse duration corresponding to the amount of fuel to be injected to sent to the air-assist fuel injection valve 6. In addition, the assist air is introduced to the air-assist fuel injection valve 6 through an assist air passage 7 communicated with the intake passage 4 upstream of the throttle valve 5.

Figure 2:
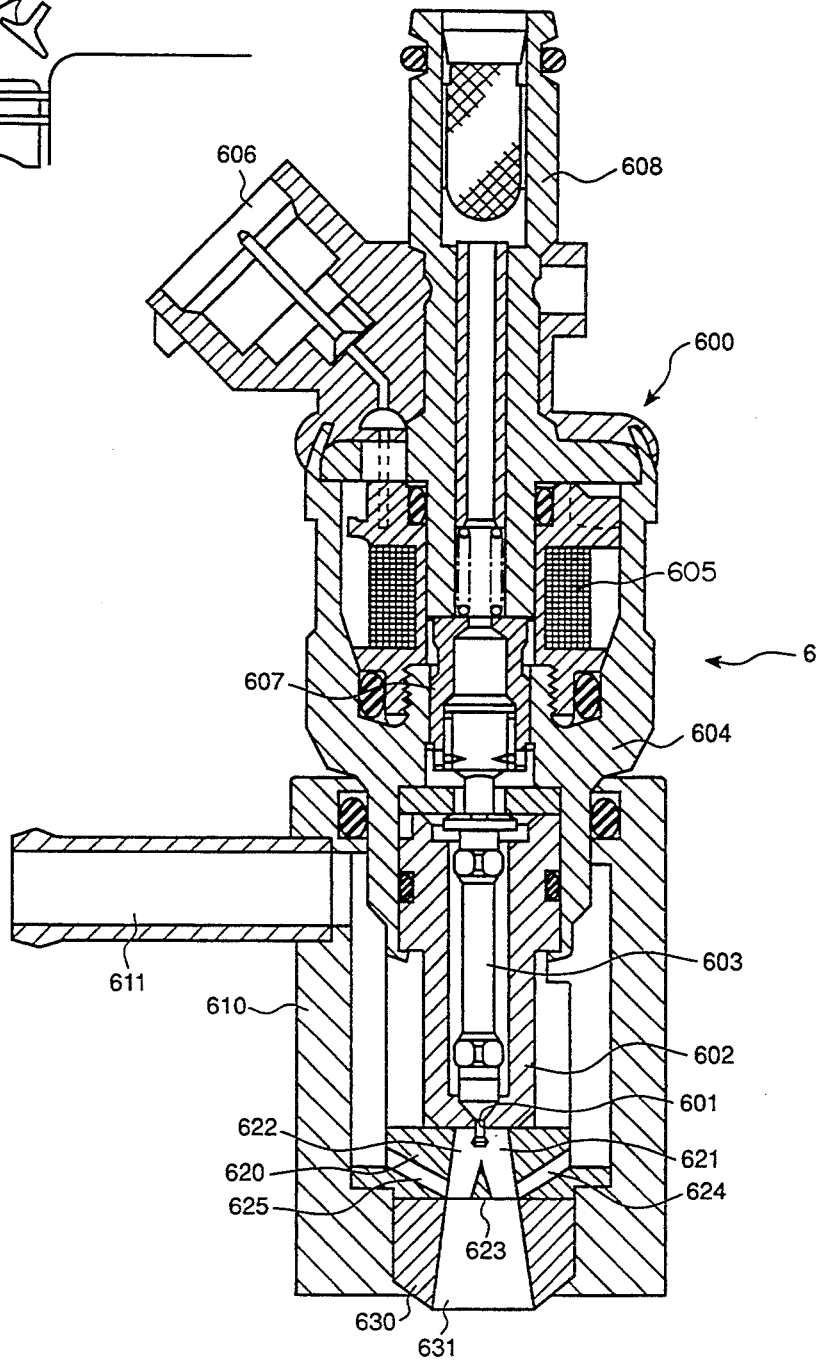
FIG. 2 is a sectional view of an air-assist fuel injection valve.

FIG. 2 is a sectional view showing the structure of the air-assist fuel injection valve 6.

The air-assist fuel injection valve 6 comprises a fuel valve section 600. A popular fuel injection valve is used as this fuel valve section 600.

The fuel valve section 600 has a valve housing 602 which is formed with a fuel injection nozzle 601 at the tip end thereof. A valve needle 603 serving to open and close the fuel injection nozzle 601 is received in the valve housing 602. The valve housing 602 is fixed to a housing 604. A magnet coil 605 is disposed in the housing 604 and energized by a control circuit which is not shown through a connector 606. The valve needle 603 is provided with an armature 607 so that the valve needle 603 is moved by the electromagnetic force produced due to energization of the magnet coil 605. A stator 608 is fixed to the housing 604 and the fuel is supplied to the upper end portion, in this drawing, of the stator 608 from the fuel pump which is not shown. As the magnet coil 605 is energized and, hence, the valve needle 603 is moved, the fuel injection nozzle 601 is opened so that the fuel is allowed to pass through the inside of the stator 608, the inside of the armature 607 and, further, between the valve needle 603 and the valve housing 602 until it is injected from the fuel injection nozzle 601.

The fuel valve section 600 is inserted in a case 610 which serves to form assist air passage. The case 610 is equipped with a pipe 611 so that the assist air is introduced from the assist air passage 7 into the case 610 through the pipe 611. Within the case 610, a sleeve 620 and a socket 630 are disposed at the tip end portion of the valve housing 602 of the fuel valve section 600. By inserting and fixing the fuel valve section 600 in the case 610, the sleeve 620 and the socket 630 are fixedly held between the fuel valve section 600 and the case 610.

The sleeve 620 is formed with two fuel passages 621 and 622 through which the fuel injected from the fuel injection nozzle 601 is made to pass. A partition wall 623 is formed between these two fuel passages 621, 622 so as to divide into two parts the fuel injected from the fuel injection nozzle 601. Each of the two fuel passages 621, 622 is conical in shape so that the sectional area thereof is reduced as going toward the downstream of the spray of the fuel.

Further, the sleeve 620 is formed with two assist air passages 624 and 625 through which the assist air is made to pass. The upstream ends of the assist air passages 624, 625 are opened into the interior space of the case 610, while the downstream ends of the assist air passages 624, 625 are opened into the downstream parts of the fuel passages 621, 622 of the sleeve 620, respectively. The axis of the assist air passage 624 crosses the axis of the fuel passage 621, while the axis of the assist air passage 625 crosses the axis of the fuel passage 622. Further, the axes of the two assist air passages 624, 625 cross each other at a point downstream of the partition wall 623.

The socket 630 is formed with a conical passage 631 which serves to regulate the spray cone angle of the fuel.

The air-assist fuel injection valve 6 shown in FIG. 2 is fixed in the intake passage 4 of the internal combustion engine so that the axes of the two fuel passages 621, 622 are directed respectively to the intake valves of the internal combustion engine and the two sprays of fuel injected through the two fuel passages 621, 622 are directed respectively to the intake valves.

Figure 3:
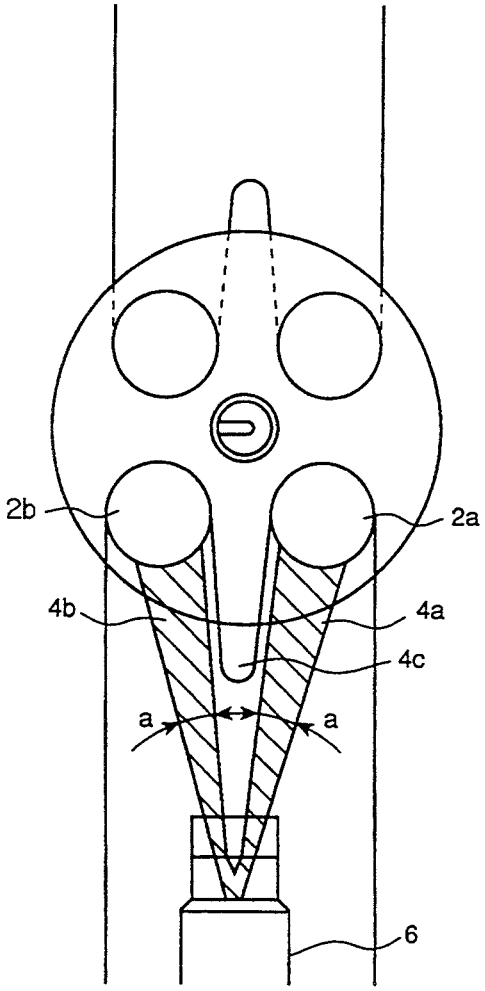
FIG. 3 is a schematic view showing a form of atomization of fuel issued from the air-assist fuel injection valve.
Figure 4:
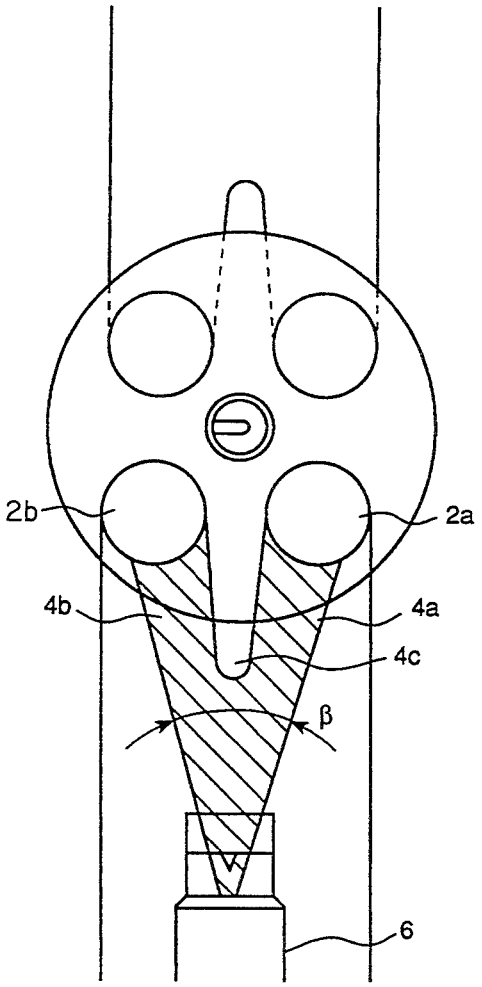
FIG. 4 is a schematic view showing another form of atomization of the fuel issued from the air-assist fuel injection valve.

FIGS. 3 and 4 are schematic views each showing the form of spraying of the fuel from the fuel injection valve to the intake valves of the internal combustion engine. The internal combustion engine is equipped with two intake valves 2*a* and 2*b*. The intake passage 4 is branched off into two intake ports 4*a* and 4*b* which are communicated with the two intake valves 2*a* and 2*b*, respectively. An intermediate wall 4*c* is formed between the two intake ports 4*a*, 4*b*. It is noted that, in FIGS. 3 and 4, the form of spraying from the fuel injection valve 6 is shown as the hatched section and the spray cone angle is indicated by $\alpha$ or $\beta$.

Next, operation of the above-described embodiment will be described.

In this embodiment, when the throttle valve 5 is opened, the differential pressure of the assist air passage 7 is caused to disappear to cut the assist air, resulting in that the injection of the assist air from the assist air passages 624, 625 is stopped. As the magnet coil 605 of the fuel valve section 600 is energized while the throttle valve 5 is being opened, the fuel is injected from the fuel injection nozzle 601. The fuel injected from the fuel injection nozzle 601 is separated into the two fuel passages 621, 622. The fuel passed through the two fuel passages 621, 622 becomes two sprays of fuel the spray cone angle of which is narrow as indicated by $\alpha$ in FIG. 3. These-sprays of fuel each having the narrow spray cone angle $\alpha$ are made to pass through the passage 631 and then go toward the two intake valves 2*a*, 2*b*, respectively.

In consequence, fuel adhesion to the inside of the intake passage 4 can be prevented when the engine is operated in the high rotational speed and high load condition, that is, when the throttle valve 5 is opened, so that it is possible to supply the fuel to the combustion chamber with reliability, resulting in that it is possible to improve the transient response characteristic of the engine, particularly the transient response characteristic obtained when heavy gasoline is used.

As the throttle valve 5 is closed, the differential pressure arises in the assist air passage 7 so as to allow the assist air to be supplied into the case 610, resulting in that the assist air is jetted through the assist air passages 624, 625. As the magnet coil 605 of the fuel valve section 600 is energized when the throttle valve 5 is closed, the fuel is injected from the fuel injection nozzle 601. The fuel injected from the fuel injection nozzle 601 is separated into the two fuel passages 621, 622. Since the assist air is introduced to the downstream parts of the fuel passages 621, 622, the fuel passed through the two fuel passages 621, 622 collides with the assist air so as to be disposed. At this time, dispersion of the sprayed fuel is regulated by the passage 631 formed in the socket 630, and however, it becomes a single spray of fuel having a wide spray cone angle $\beta$ as shown in FIG. 4.

In consequence, atomization of fuel can be promoted when the engine is operated in the low rotational speed and low load condition, that is, when the throttle valve 5 is closed, so that it is possible to supply the mixture of high quality, with the result that it is possible to reduce the emission and the change of combustion as well as to improve the transient response characteristic. Particularly in the case that, since a large quantity of fuel is injected when the temperature of the internal combustion engine is low, the magnet coil 605 is energized for a long time and the injection is started before the rising of air stream in the seat portions of the intake valves 2*a*, 2*b*, fuel adhesion to the intake pipe can be reduced and hence the fuel can be supplied to the combustion chamber with reliability owing to the large spray cone angle of the fuel and the promotion of the atomization.

As described above, according to this embodiment, it is possible to inject the fuel in accordance with the operating condition of the internal combustion engine and reduce the fuel adhesion to the intake passage caused at the time of increasing the amount of fuel in the case that the fuel is injected toward the intake valves, resulting in that it is possible to reduce the emission and the change of combustion as well as to improve the transient response characteristic of the internal combustion engine.

Figure 5:
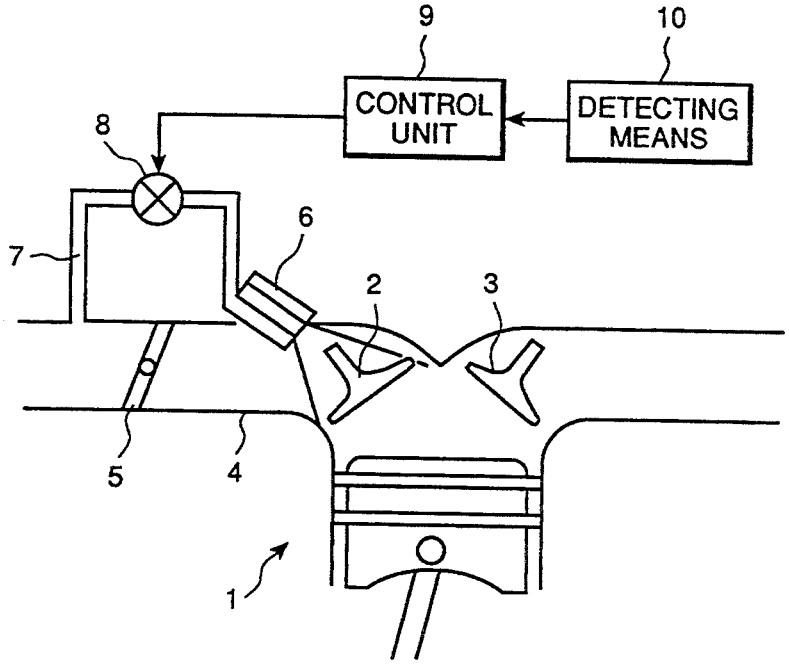
FIG. 5 is a structural view showing a schematic structure of a second embodiment of the present invention.

Next, description will be given of a second embodiment of the present invention with reference to FIGS. 5 and 6. FIG. 5 is a structural view showing a schematic structure of the second embodiment.

The assist air passage 7 is provided with a control valve 8 which serves to open and close this passage. The control valve 8 serves to open and close the assist air passage 7 in accordance with a signal from the control unit 9. The control unit 9 receives a signal from an operating condition detecting means 10 which serves to detect the operating condition of the internal combustion engine 1 and serves to control the control valve 8 in accordance with this operating condition. In this embodiment, it is designed that the operating condition detecting means 10 detects the low temperature condition of the internal combustion engine 1 from the cooling water temperature of the internal combustion engine.

The second embodiment has the same construction as that of the first embodiment except the above-described control valve 8 disposed in the assist air passage 7.

Figure 6:
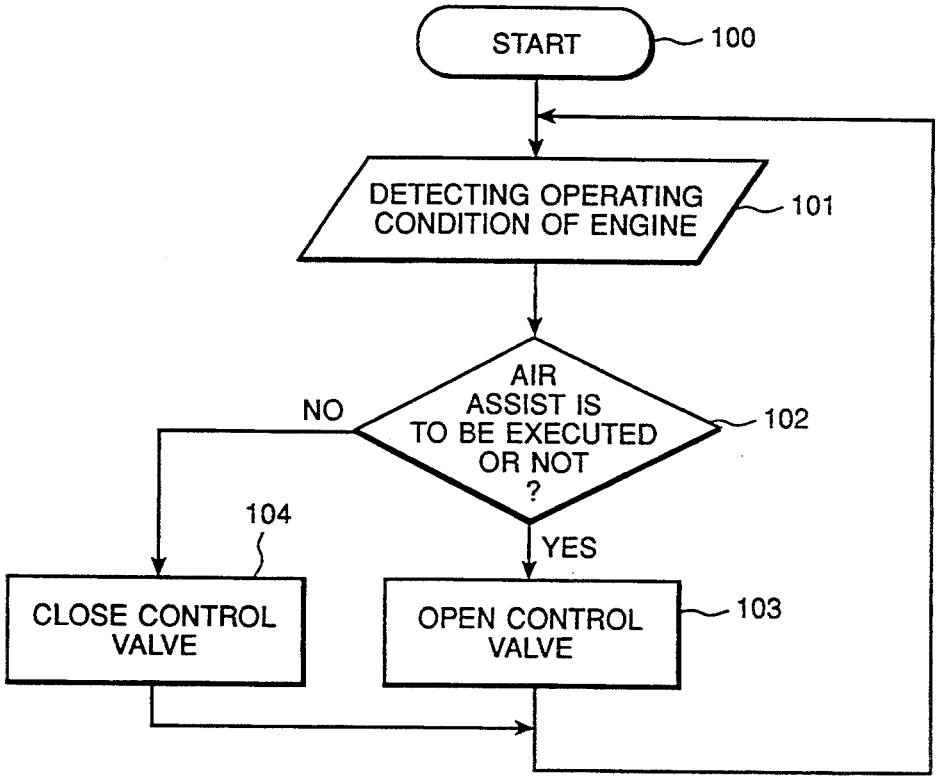
FIG. 6 is a flow chart showing the operation of a control unit.

FIG. 6 is a flow chart showing the operation of the control unit 9 of the second embodiment.

At step 101, the cooling water temperature is received from the operating condition detecting means 10 as the operating condition of the internal combustion engine. At step 102, it is judged whether or not the cooling water temperature is the temperature representative of the low temperature condition of the internal combustion engine. If it is judged to be in the low temperature condition, the operation proceeds to the next step as indicated by an arrow mark YES. While if it is judged not to be in the low temperature condition, the operation proceeds to the next step as indicated by an arrow mark NO. At step 103, the control valve 8 is opened, while at step 104, the control valve 8 is closed.

According to this embodiment, only when the internal combustion engine is in the low temperature condition, the assist air is supplied and the atomization of the fuel is promoted. It is therefore possible to reduce the emission and the change of combustion as well as to improve the transient response characteristic of the internal combustion engine.

Although the supply of the assist air is interrupted in accordance with the cooling water temperature of the engine in the above second embodiment, it is possible to interrupt the supply of the assist air in accordance with the operating condition of the internal combustion engine such as the gear changing operation of the transmission, for example. Further, it is also possible that, by linking to a variable intake device which varies the intake valve operating timing of the internal combustion engine, the assist air is supplied only in the case that the timing at which the intake valve is opened is delayed so as to cause the fuel injection to start before the intake valve is opened, thereby promoting the atomization of the fuel.

Next, a third embodiment of the present invention will be described. Although the aforesaid first embodiment employs the air-assist fuel injection valve of the structure of FIG. 2, the third embodiment employs an air-assist fuel injection valve shown in FIGS. 7 to 19 in place of the air-assist fuel injection valve of FIG. 2. It is noted that the air-assist fuel injection valve of this embodiment is fixed in the intake passage of the internal combustion engine in the same manner as the first embodiment.

Figure 7:
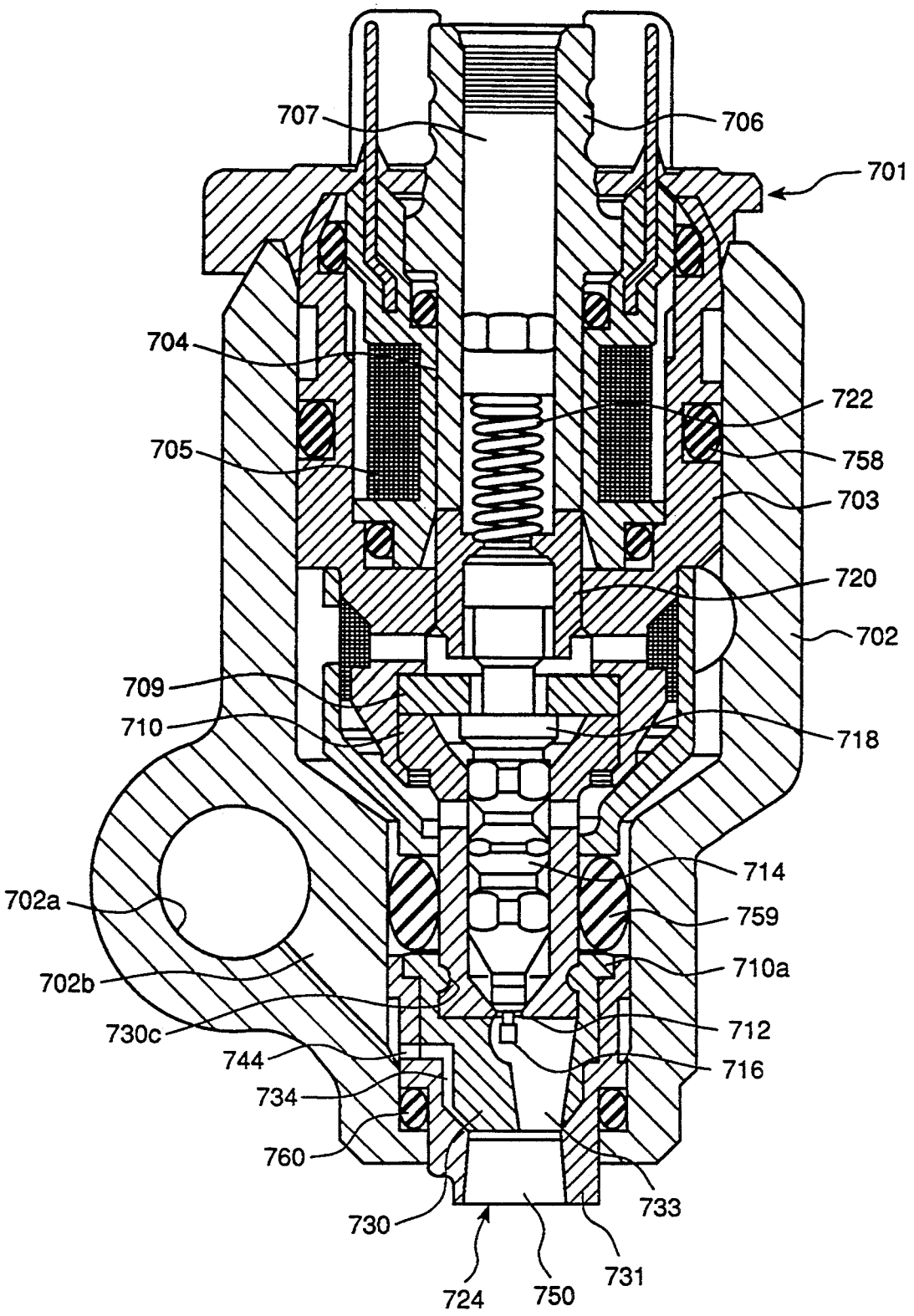
FIG. 7 is a sectional view of a fuel injection valve according to a third embodiment of the present invention.

As shown in FIG. 7, an electromagnetic type fuel injection valve 701 is fitted in a delivery pipe 702 which serves to supply the fuel to the cylinders of the internal combustion engine. A housing 703 of the fuel injection valve 701 is formed in the shape of a stepped cylinder and a magnet coil 705 wound on a spool 704 is disposed in the large diameter portion of the housing 703. A cylindrical iron core 706 extends through the spool 704 from above and an adjusting pipe 707 is disposed within the iron core 706 so as to be axially slidable.

A nozzle body 710 is lap fixed in the small diameter portion of the housing 703 through a spacer 709 and an injection nozzle 712 is formed in a downward projected end surface of the nozzle body 710. A needle valve 714 is disposed in the nozzle body 710 from above so as to be slidable. A pintle 716 is formed at the tip end of the needle valve 714, which pintle 716 penetrates through the injection nozzle 712 leaving a gap from the inner peripheral wall of the latter and projects out from the injection nozzle 712. On the other hand, a stopper 718 is formed substantially in the middle of the needle valve 714 so as to be opposite to the spacer 709. Further, a movable core 720 is provided at the top end of the needle valve 714 so as to be opposite to and connected with the iron core 706. The movable core 720 is biased downward by a coiled spring 722 disposed between the iron core 706 and the adjusting pipe 707. A split sleeve 724 is provided at the end portion of the body 710 in which the injection nozzle 712 is formed in such a manner that it covers the end portion of the body 710.

Figure 8:
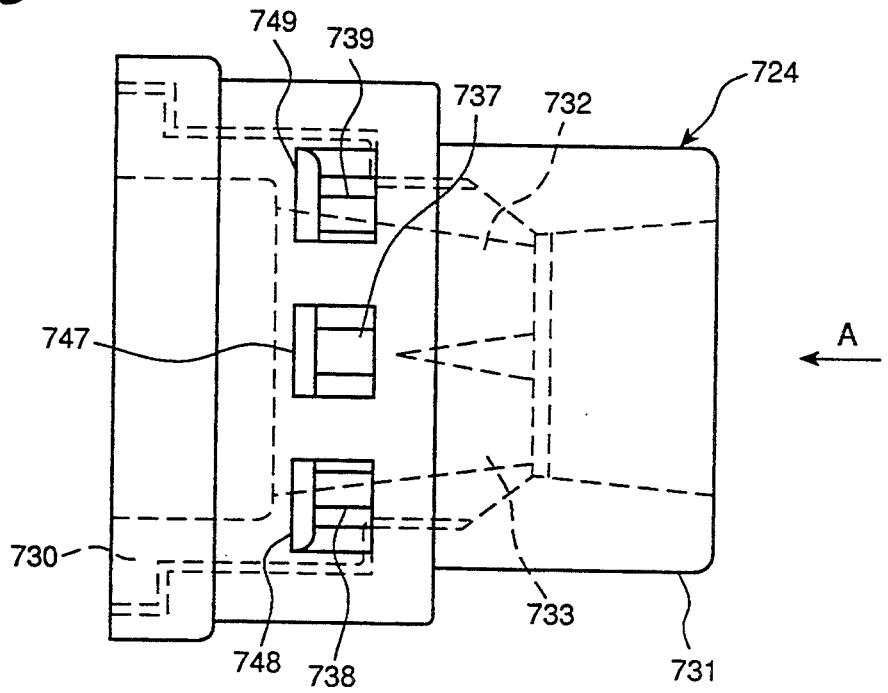
FIG. 8 is a side view of a sleeve.
Figure 9:
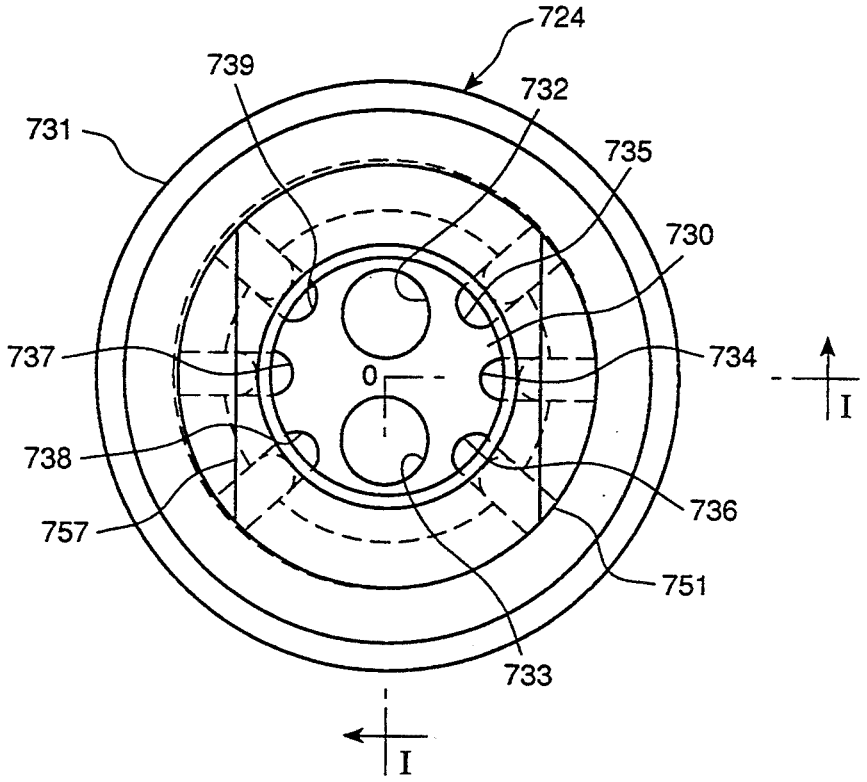
FIG. 9 is a view as viewed from an arrow mark direction A of FIG. 8.

The sleeve 724 comprises an inner sleeve nozzle 730 and an outer cover nozzle 731 as shown in FIGS. 8 and 9. The sleeve nozzle 730 and the cover nozzle 731 constituting the sleeve 724 are made of 6—6 nylon (containing 30 wt % glass), polyacetals, PPS or the like.

The inner sleeve nozzle 730 has two fuel passages 732 and 733. The fuel passages 732 and 733 are each conical in shape so that the sectional area thereof is reduced as going toward the downstream of the spray of the fuel. The inner sleeve nozzle 730 is formed in the outer peripheral wall thereof with semicircular grooved portions 734, 735, 736, 737, 738 and 739 each of which serves to form an air passage. The grooved portion 734 serving to form the air passage can have the cross section of rectangular shape shown in FIG. 16, for example, in place of the cross section of circular arc shape shown in FIG. 15. The inner sleeve nozzle 730 has a tapered surface 730*a* and an annular stepped portion 730*b*.

Figure 10:
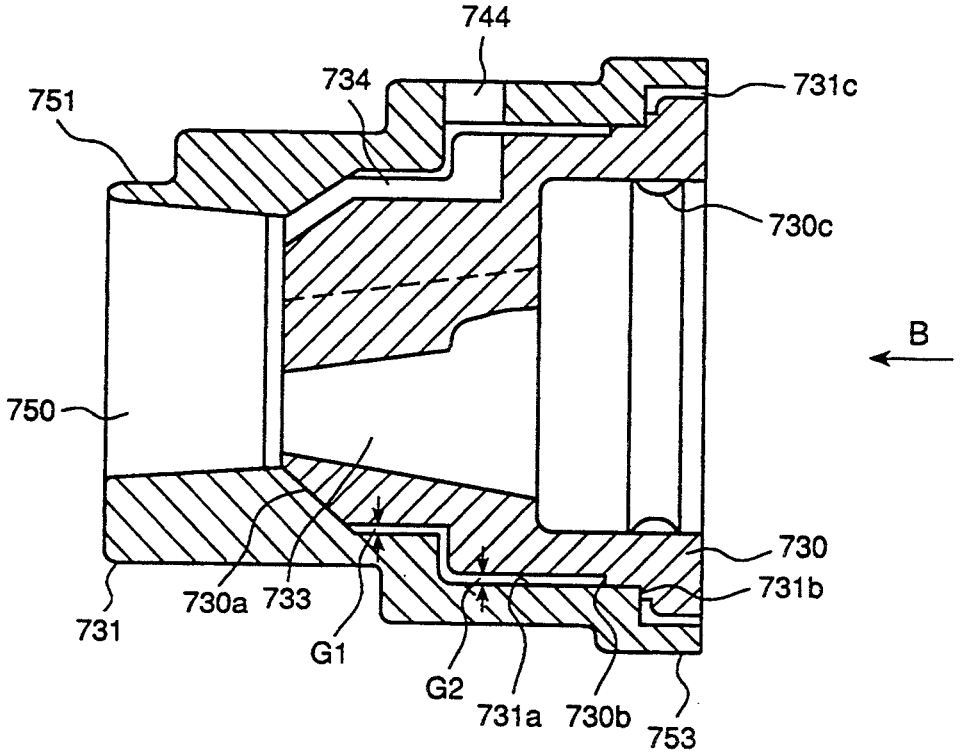
FIG. 10 is a sectional view taken along the line I-O-I of FIG. 9.

The outer cover nozzle 731 has six holes 744, 745, 746, 747, 748 and 749, for example, these holes each penetrating from the inside wall to the outside wall and serving to form an air induction port. It is sufficient for each of the holes 746 to 749 to have a passage area which is not smaller than the passage area surrounded by the grooved portion 734, 735, 736, 737, 738 or 739 and the inside wall of the cover nozzle 731. Further, the cover nozzle 731 is formed at the tip end thereof with a diffuser portion 750 which serves to guide the spray of the fuel stirred and atomized by the assist air and regulate the same within the desired spray cone angle as well as a chamfered portion 751 which is to be used for positioning in the automatic assembling process. Gaps G1 and G2 shown in FIG. 10 are designed to have a clearance of about 0.1 to 0.3 mm. This makes it possible to prevent parts other than the stepped portion 730 from being melted and welded at the time of the ultrasonic welding which is to be described later, thereby preventing the assist air passage from being clogged due to generation of unnecessary fins.

Figure 11:
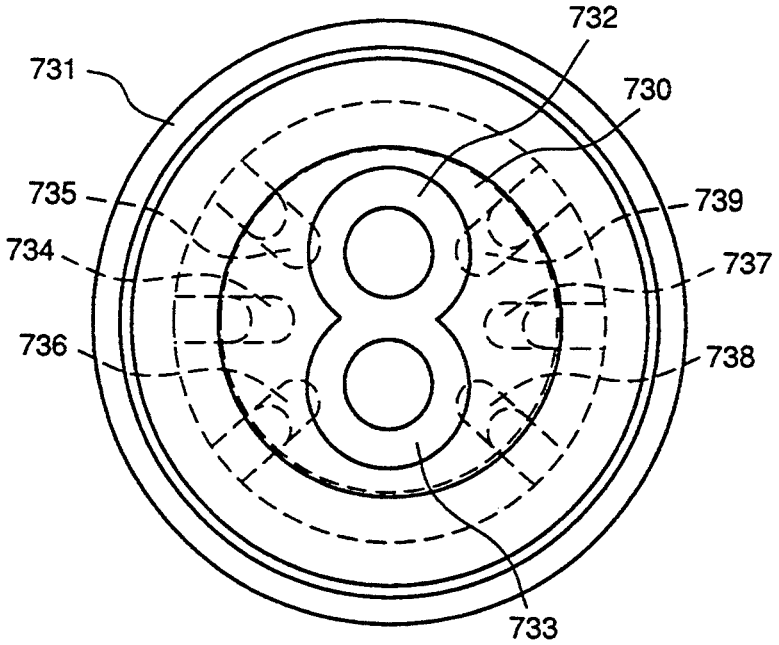
FIG. 11 is a view as viewed from an arrow mark direction B of FIG. 10.
Figure 12:
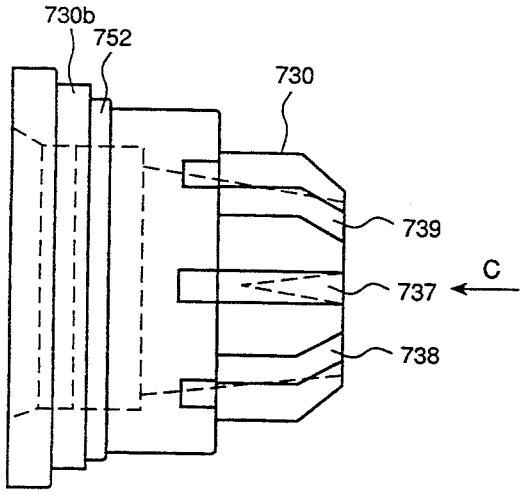
FIG. 12 is a side view showing the shape of a sleeve nozzle according to the third embodiment of the present invention before it is melted.
Figure 14:
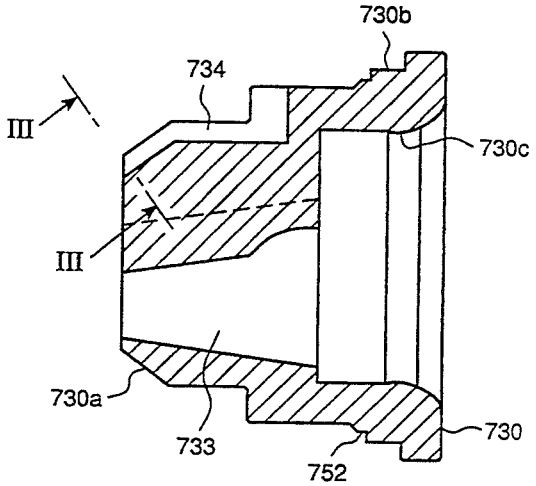
FIG. 14 is a sectional view taken along the line II-O-II of FIG. 13.
Figure 13:
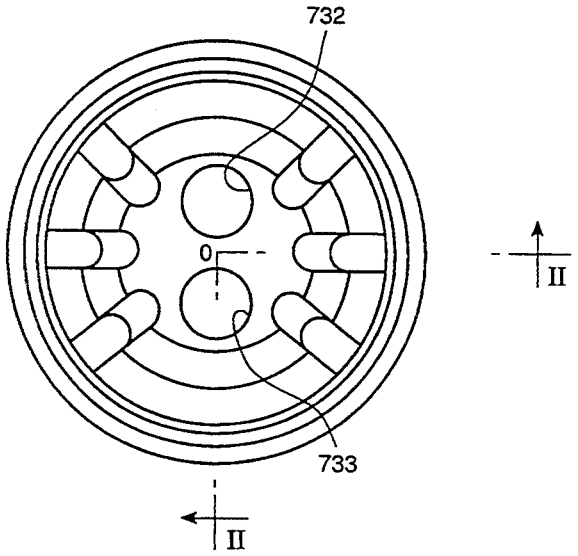
FIG. 13 is a view as viewed from an arrow mark direction C of FIG. 12.
Figure 15:
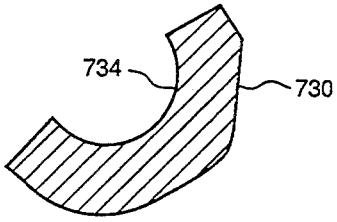
FIG. 15 is a sectional view taken along the line III—III of FIG. 14.
Figure 16:
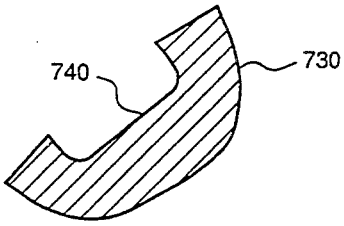
FIG. 16 is a sectional view showing a modification of the groove shape of FIG. 15.
Figure 17:
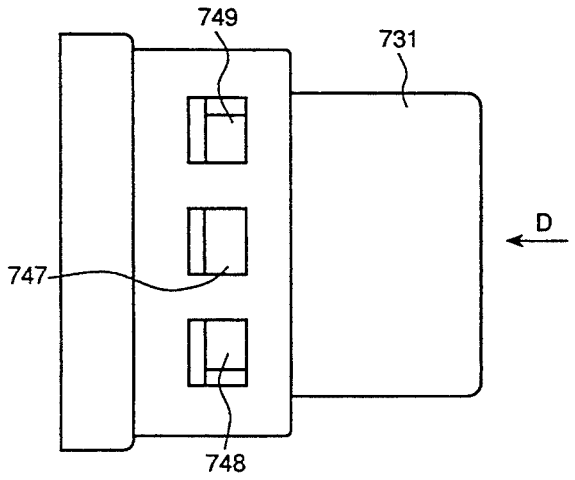
FIG. 17 is a side view of a cover nozzle according to the third embodiment of the present invention.
Figure 19:
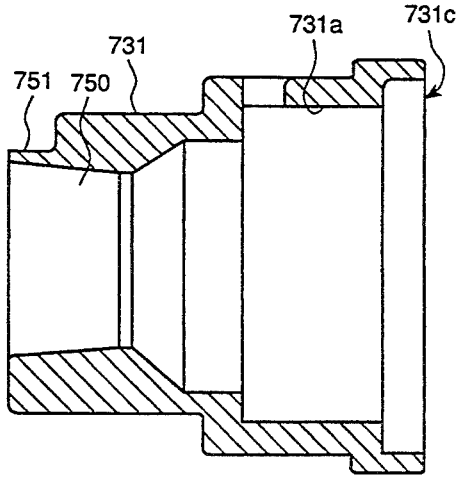
FIG. 19 is a sectional view taken along the line IV-O-IV of FIG. 18.
Figure 18:
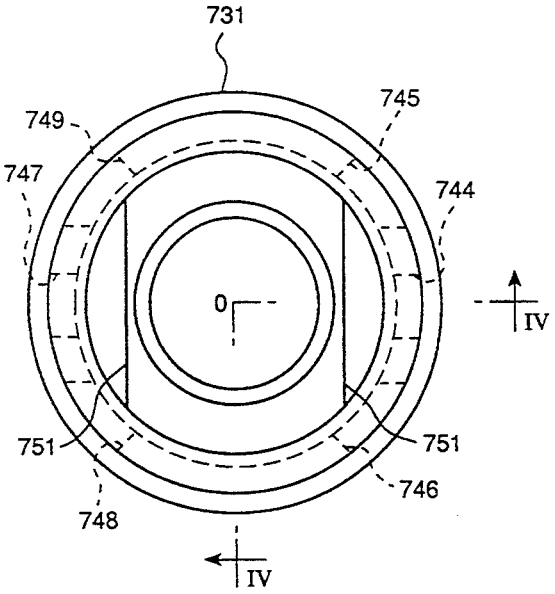
FIG. 18 is a view as viewed from an arrow mark direction D of FIG. 17.

FIGS. 8 to 11 are illustrations showing the structure of the sleeve nozzle 730 after the welding. Namely, FIG. 8 is a side view of the sleeve nozzle 730, FIG. 9 is a view as viewed from an arrow mark direction A of FIG. 8, FIG. 10 is a sectional view taken along the line I-O-I of FIG. 9, and FIG. 11 is a view as viewed from an arrow mark direction B of FIG. 10. Further, FIGS. 12 to 14 are illustrations showing the shape of the sleeve nozzle 730 before it is welded, in which FIG. 12 is a side view, FIG. 13 is a view as viewed from an arrow mark direction C of FIG. 12, and FIG. 14 is a sectional view taken along the line II-O-II of FIG. 13. Moreover, FIG. 15 is a sectional view taken along the line III—III of FIG. 14. In addition, FIGS. 17 to 19 are illustrations showing the shape of the cover nozzle 731 before it is welded, in which FIG. 17 is a side view, FIG. 18 is a view as viewed from an arrow mark direction D of FIG. 17, and FIG. 19 is a sectional view taken along the line IV-O-IV of FIG. 18.

It is noted here that FIGS. 12 to 14 illustrate the stepped portion 730*b* and the guide portion 752, the stepped portion 730*b* being shown for a longer distance in the axial direction as compared with FIGS. 8 to 11. This axial elongated portion of the stepped portion 730*b* is the portion which is to be melted at the time of the ultrasonic welding which is to be described later. On the other hand, the guide portion 752 is formed to have an outside diameter which is substantially equal to an inside diameter of the cylindrical surface 731*a* of the cover nozzle 731 shown in FIG. 19, which guide portion forms a guide surface by means of which the sleeve nozzle 730 is inserted into the cover nozzle 731 with the stepped portion 730*b* thereof being melted in the welding process, so that affixed gap is maintained between the cover nozzle 731 and the sleeve nozzle 730.

Within the delivery pipe 702, the passage of the fuel taken from the fuel intake port is formed between a first O ring 758 and a second O ring 759. The air induced through an air passage 702*a* and a passage 702*b* formed in the delivery pipe 702 is radially sealed between the second O ring 759 and a third O ring 760.

Next, description will be given of the procedure for manufacturing the above-described embodiment.

The cover nozzle 731 and the sleeve nozzle 730 are formed by means of the injection molding. The both nozzles are unified by being welded to each other as the sleeve nozzle 730 is inserted into the cover nozzle 731. The sleeve nozzle 730 is inserted from an opening 731*c* of the cover nozzle 731.

On the occasion of the welding, as shown in FIG. 10, the sleeve nozzle 730 is inserted into the cover nozzle 731, the cover nozzle 731 and the sleeve nozzle 730 are pressed against each other so that the stepped portion 730*b* and the stepped portion 731*b* are subjected to the ultrasonic pressure, thereby melting the stepped portion 730*b* by ultrasonic vibrations. Fins produced by ultrasonic waves are received in a fin receiver 753 so as to avoid exerting bad influence on the O ring 760 shown in FIG. 7. In the course of press-fitting the sleeve nozzle 730 while melting the stepped portion 730*b* by the ultrasonic waves, when the tapered surface 730*a* is brought into contact with the cover nozzle 731, application of the ultrasonic vibrations is brought to an end.

In the welding process described above, in case of press-fitting the sleeve nozzle 730 while melting the stepped portion 730*b*, the gaps G1 and G2 are maintained due to the guide portion 752 as shown in FIG. 10, thereby preventing generation of fins caused due to unnecessary melting and welding.

In FIG. 7, the sleeve nozzle 730 is assembled to the fuel injection valve 701 in such a manner that the sleeve nozzle 730 is press-fitted on the outer periphery of the nozzle body 710 of the fuel injection valve 701 and, in order to prevent come-off, a grooved portion 710*a* and a projection 730*c* are fastened to each other by means of snap-fitting. In this case, the relative position of the nozzle body 710 and the sleeve nozzle 730 in the direction of rotation is decided as well.

According to the above-described embodiment, the fuel taken from the fuel intake port is passed through the regulating portion and then injected through the injection nozzle 712. The injected fuel is divided into two directions by the fuel passages 732, 733 of the sleeve nozzle 730 and, thereafter, atomized at once due to air jets issued from the grooves 734, 735, 736, 737, 738 and 739.

Further, according to the above-described embodiment, since the supply of the assist air is interrupted, it is possible to obtain two spraying patterns, that is, fuel injection with high directivity and spray of well atomized fuel. Particularly, by directing the two fuel passages 732, 733 formed in the sleeve nozzle 730 toward the intake valves of the internal combustion engine, respectively, when the assist air is out off, the fuel passing through the fuel passages 732, 733 can be supplied to the intake valves with high directivity. This makes it possible to reduce the amount of fuel adhered to the wall surface of the intake pipe and hence to supply the required amount of fuel to the combustion chamber of the internal combustion engine with accuracy. Further, in the above-described embodiment, the outlets of the assist air passages formed between the cover nozzle 731 and the sleeve nozzle 730 are so arranged as to cross the streams of fuel injected from the fuel passages 732, 733 at the outlets of the two fuel passages 732, 733 and, moreover, they are distributed substantially uniformly around the two fuel passages 732, 722, as shown in FIGS. 9 and 10 in detail. For this reason, it is possible to make the fuel injected from the two fuel passages 732, 733 collide against the assist air effectively when the assist air is supplied, thereby making it possible to obtain the spray of fuel in which the fuel is atomized satisfactorily and stirred as if it is a single stream of sprayed fuel. In consequence, mixing with the air taken into the internal combustion engine can be assured favorably and the fuel can be taken into the combustion chamber with reliability by being carried by the flow of intake air even when the amount of intake air is small, so that the required amount of fuel can be supplied to the combustion chamber of the internal combustion engine as being held in the state suitable to obtain a good combustion.

Further, in the foregoing description, the number of fuel passages has been described as being two since the number of intake valves is two, and however, it is possible to easily design the number of fuel passages to be even one or more then three as occasion demands. Incidentally, the supply of the assist air can be interrupted in accordance with the load of the internal combustion engine or the like. For example, it is possible to supply the assist air at the time of low load operation in which the amount of intake air is small while cut off at the time of high load operation in which the amount of intake air is large.

With the structure of the above-described embodiment, in forming the assist air passage in the resinous sleeve 724, the sleeve 724 is divided into two parts, that is, the inner cylindrical sleeve nozzle 730 and the outer cylindrical cover nozzle 731, and the assist air passage is formed between them, and therefore, it becomes possible to form a plurality of assist air passages each having a complicated shape without difficulty.

Moreover, the induction ports of the assist air are formed as penetrating through the cover nozzle 731 from the outside wall to the inside wall, and the cover nozzle 731 is overlapped by the sleeve nozzle 730 at the portion thereof nearer to the fuel injection valve than (or above) these induction ports, and the cover nozzle 731 and the sleeve nozzle 730 are welded to each other at this overlapped portion, and therefore, it is possible to prevent generation of fins and clogging of the assist air passages which are expected to take place when the cover nozzle 731 and the sleeve nozzle 730 are welded to each other around the assist air passages formed below the induction ports.

In addition, in order to form the gap between the cover nozzle 731 and the sleeve nozzle 730 except the above overlapped portion, when the cover nozzle 731 and the sleeve nozzle 730 are welded to each other at the above-described overlapped portion as the sleeve nozzle 730 is inserted into the cover nozzle 731, the guide portion 752 is formed. Therefore, it is possible to prevent the cover nozzle 731 and the sleeve nozzle 730 from being welded to each other around the assist air passages and hence to prevent the generation of fine and the clogging of the assist air passages.

Figure 20:
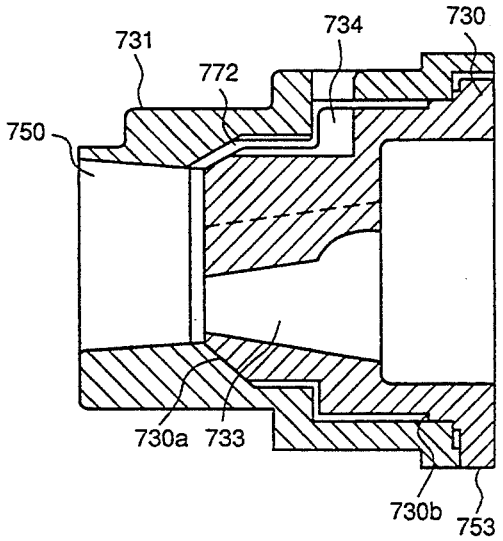
FIG. 20 is a sectional view of a sleeve according to a fourth embodiment of the present invention.

FIG. 20 shows a fourth embodiment of the present invention.

In the fourth embodiment, the assist air passages are formed in the cover nozzle 731. Each assist air passage 772 is formed by slotting the inner wall of the cover nozzle 731.

Figure 21:
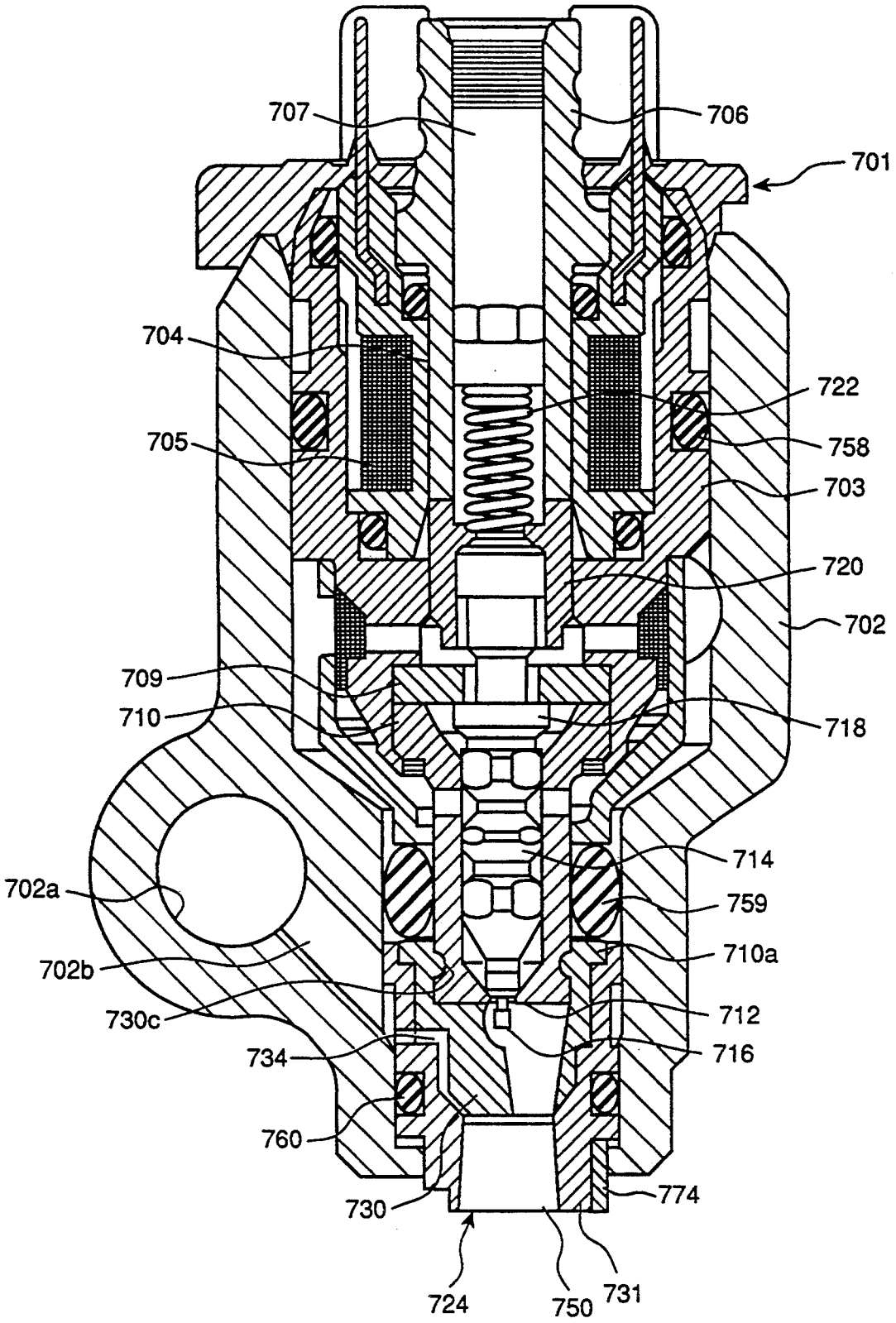
FIG. 21 is a sectional view of a fuel injection valve according to a fifth embodiment of the present invention.

FIG. 21 shows a fifth embodiment of the present invention.

In the fifth embodiment, the cover sleeve 731 is formed on the outer peripheral wall thereof with a projection 774 and the delivery pipe 702 is formed with a groove so that the sleeve 730 and the fuel injection valve 701 are positioned relative to the delivery pipe 702 due to this projection 774.

Figure 22:
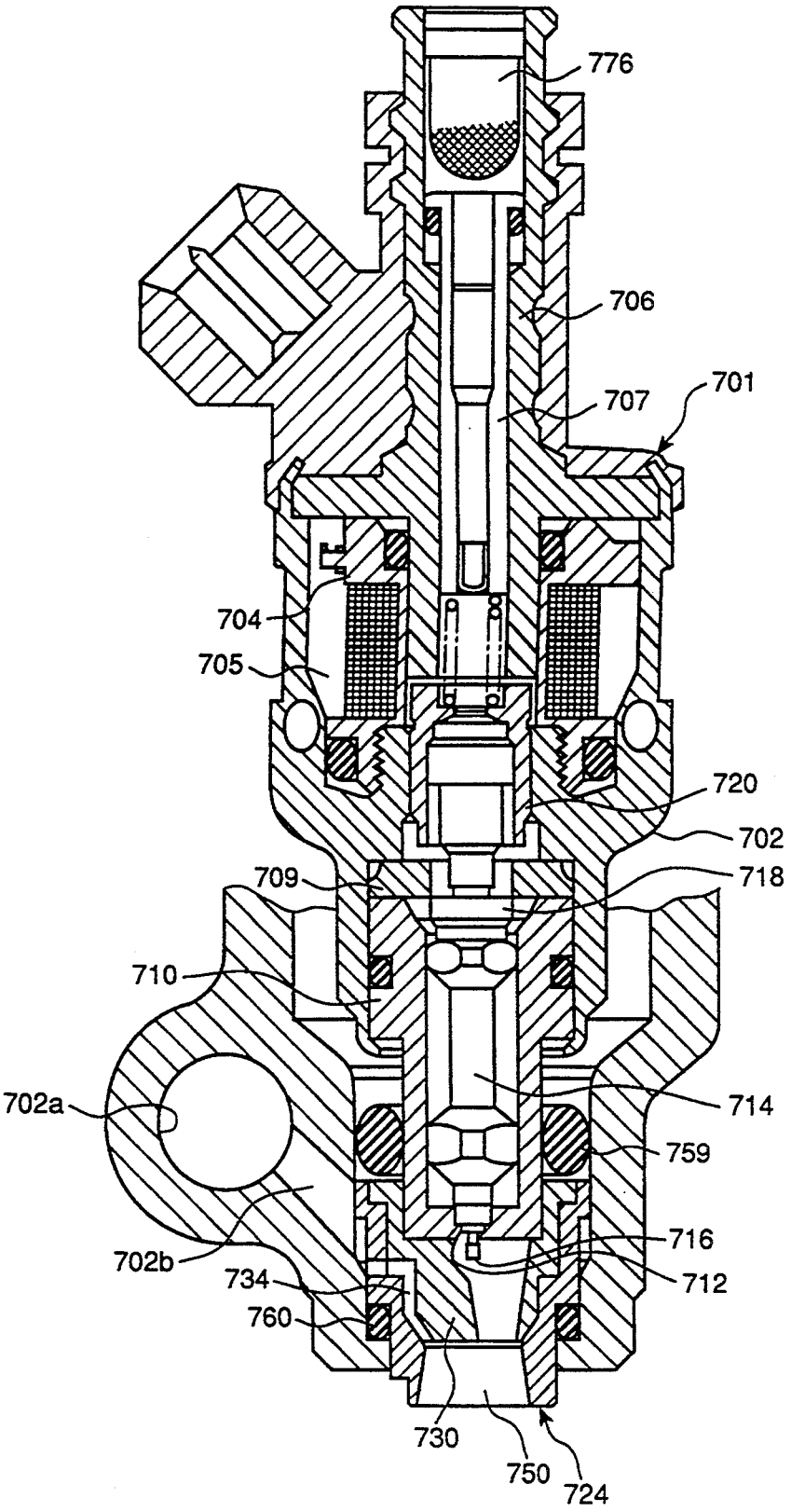
FIG. 22 is a sectional view of a fuel injection valve according to a sixth embodiment of the present invention.

FIG. 22 shows a sixth embodiment of the present invention.

In the sixth embodiment, the fuel feed passage is of the top feed type. In the sixth embodiment, the fuel is fed through a filter 776 and the inside of the adjusting pipe 707. To the fuel injection valve 701 of this top feed type is assembled the same sleeve 724 as that of the third embodiment described before.

In the embodiments described above, the assist air passage is wholly formed between the sleeve nozzle 730 and the cover nozzle 731 from the penetrating hole to the outlet thereof. However, part of the assist air passage may be formed as extending into the sleeve nozzle 730 and opened in the vicinity of the outlets of the fuel passages 732, 733 formed in the sleeve nozzle 730. In this case, the assist air passage extending into the sleeve nozzle 730 can be formed in such a manner that it is branched off from the assist air passage formed between the sleeve nozzle 730 and the cover nozzle 731 so as to extend toward the sleeve nozzle 730. This makes it possible to reduce the length of the assist air passage formed in the sleeve nozzle 730, thereby making it easy to form the assist air passage. Further, the position of the outlet of the assist air passage can be set freely relative to the positions of the outlet of the fuel passage, and therefore, it becomes possible to obtain the desired atomizing form.

As has been described above, according to the third to sixth embodiments of the fuel feed apparatus of the internal combustion engine, it goes without saying that the supply of the assist air makes it possible to obtain a favorable atomizing form and, in addition, it is possible to easily manufacture the split type sleeve that has a plurality of assist air passages of a complicated shape.

Since it is possible to easily form a plurality of complicated assist air passages by fitting and welding the inner member in and to the outer cylindrical member, high workability can be achieved in manufacturing and assembling the members, forming the assist air passages and the like operations.

Further, since the inner member is welded to the outer cylindrical member at the portion nearer to one of the openings of the outer member through which the inner member is inserted than the penetrating holes, clogging of the assist air passages, change of the passage area and the like problem can be prevented from taking place in the Manufacturing Process.

In the sleeve nozzle 730 formed using resin material of the above-described embodiments, the rotational torque at the press-fitted portion with the nozzle body 710 may fall due to deterioration caused by temperature change or humidity change, high temperature creep caused by the engine temperature, the expansion of resin caused by low-quality fuel, etc. In consequence of the decrease in the rotational torque, the sleeve 724 may be rotated relative to the fuel injection valve 701 at the time of replacement or inspection while in use.

For example, if the O-ring 759 sticks, the sleeve 724 may be rotated relative to the fuel injection valve 701 during removal of the fuel injection valve 701 from the delivery pipe 702 for the replacement of the O-ring 759, since the fuel injection valve 701 is usually removed while being rotated. After the replacement of the O-ring 759, if the fuel injection valve 701 is reinstalled with the sleeve 724 in a rotated or circumferentially displaced position, the fuel passages 732 and 733 of the sleeve 724 are displaced from the position of the delivery pipe 702 before the replacement of the O-ring 759. Therefore, the fuel passages 732 and 733 are not directed toward the intake valves of the internal combustion engine. For this reason, it is feared that most of the fuel injected through the fuel passages 732 and 733 adhere to the wall of the intake pipe, and the required amount of fuel is not supplied to the combustion chamber, producing abnormal exhaust gas.

FIGS. 23 to 27 show a seventh embodiment, which solves the above-described problems.

Figure 23:
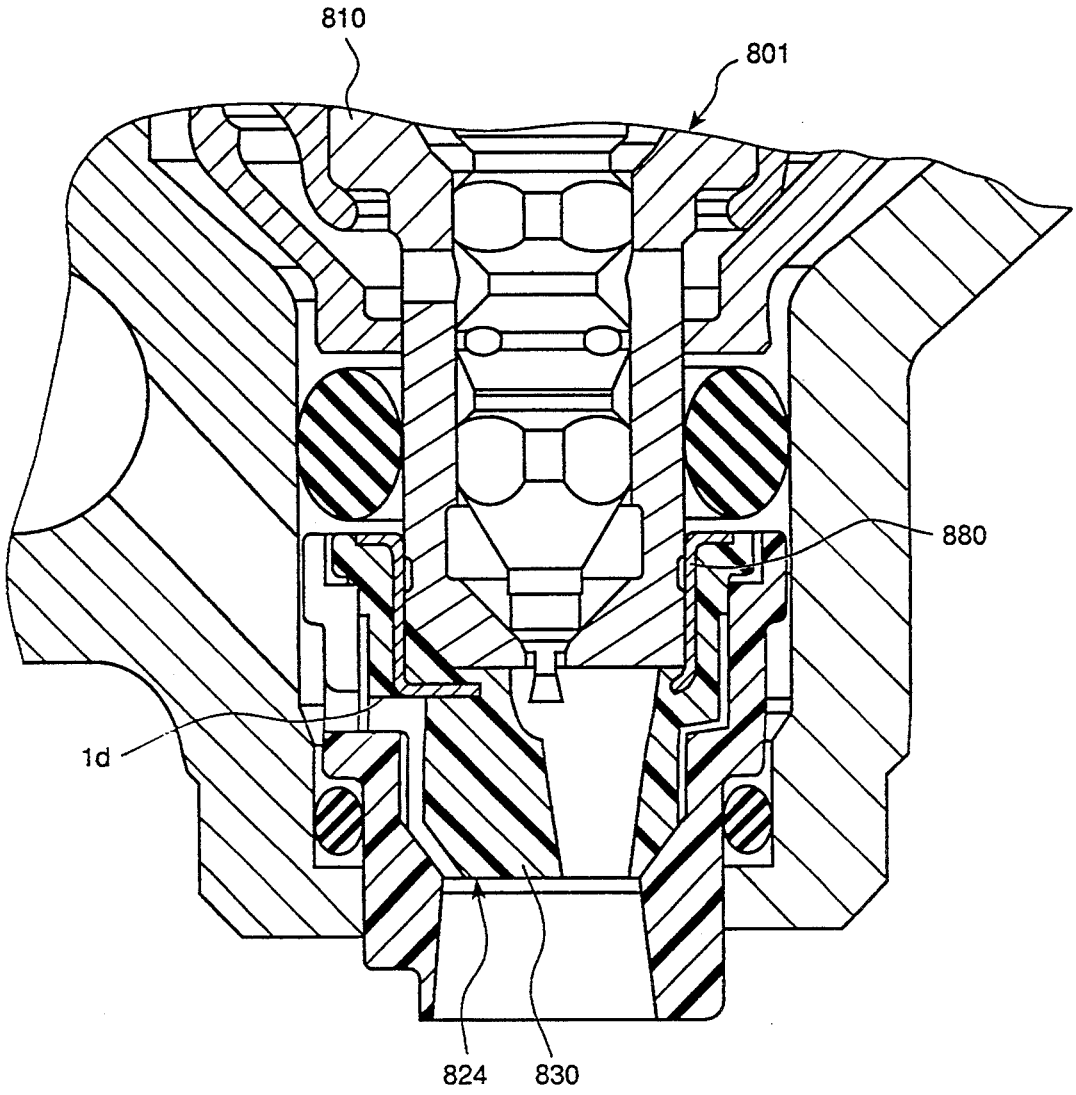
FIG. 23 is a sectional view of a fuel injection valve according to a seventh embodiment of the present invention.

FIG. 23 is a sectional view showing the principal portion of the fuel injection valve of the seventh embodiment. As shown in FIG. 23, in the seventh embodiment, a metallic ring 880 is disposed on the inner surface of the press-fitted portion of the sleeve nozzle 830 in order to prevent a decrease in the rotational torque at the press-fitted portion where the sleeve nozzle 830 is press-fitted to the metallic nozzle body 810 so that the metallic ring 880 directly contacts with the nozzle body 810.

Figure 24:
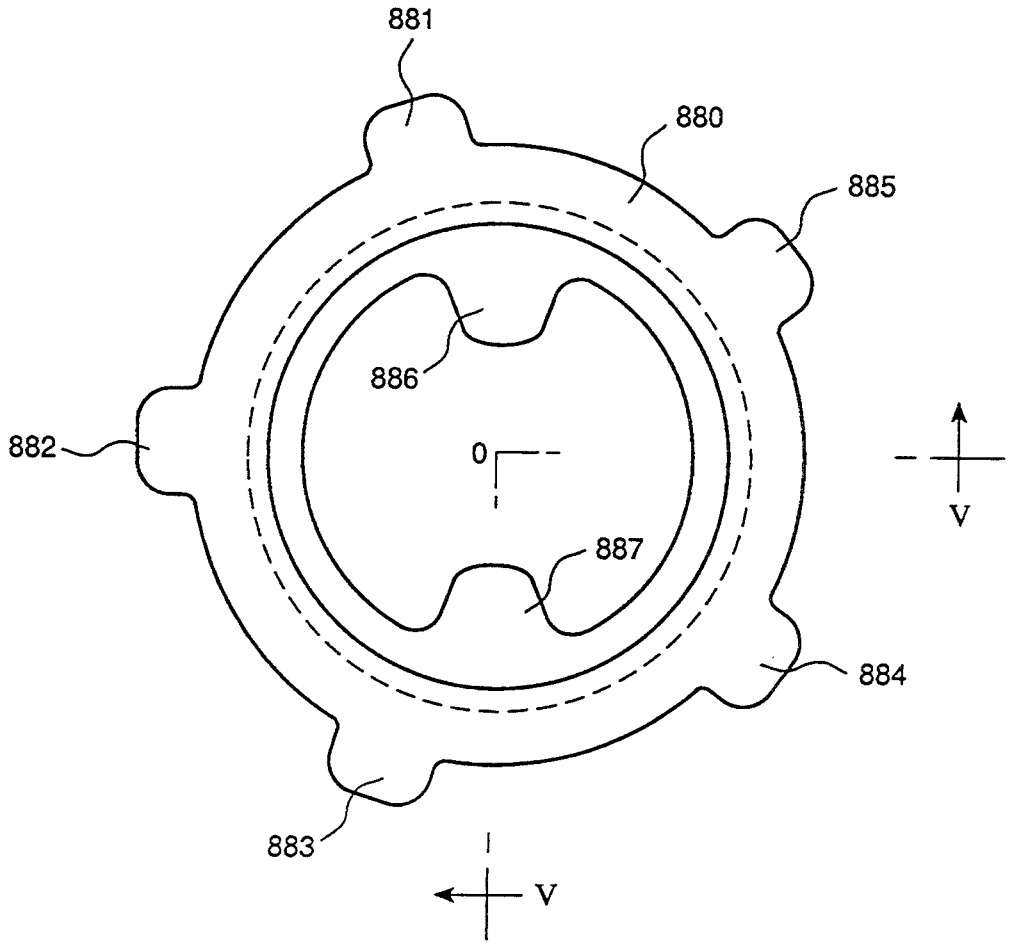
FIG. 24 is a top view of metallic ring 880.
Figure 25:
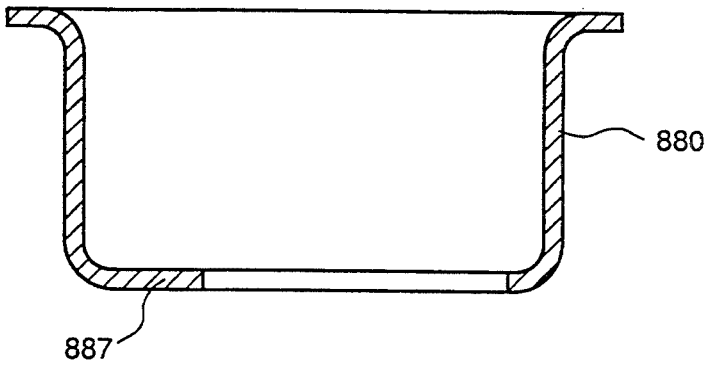
FIG. 25 is a sectional view of metallic ring 880.

FIGS. 24 and 25 illustrate the shape of the metallic ring 880. FIG. 24 is a top view of the metallic ring 880, and FIG. 25 is a sectional view taken along the line V-O-V of FIG. 24.

The metallic ring 880 is a member formed by press molding in the shape of a cup with a hole disposed at the bottom. The opening end of the metallic ring 880 is bent perpendicular to the axis, on which five claws 881, 882, 883, 884 and 885 are formed at the bend. In addition, two claws 886 and 887 project to the inside of the hole at the bottom. Further, the metallic ring 880 is formed using SUS310S, SUS304L, SUS316L, SUS430 or other stainless steel that is resistant to stress corrosion cracking.

Figure 26:
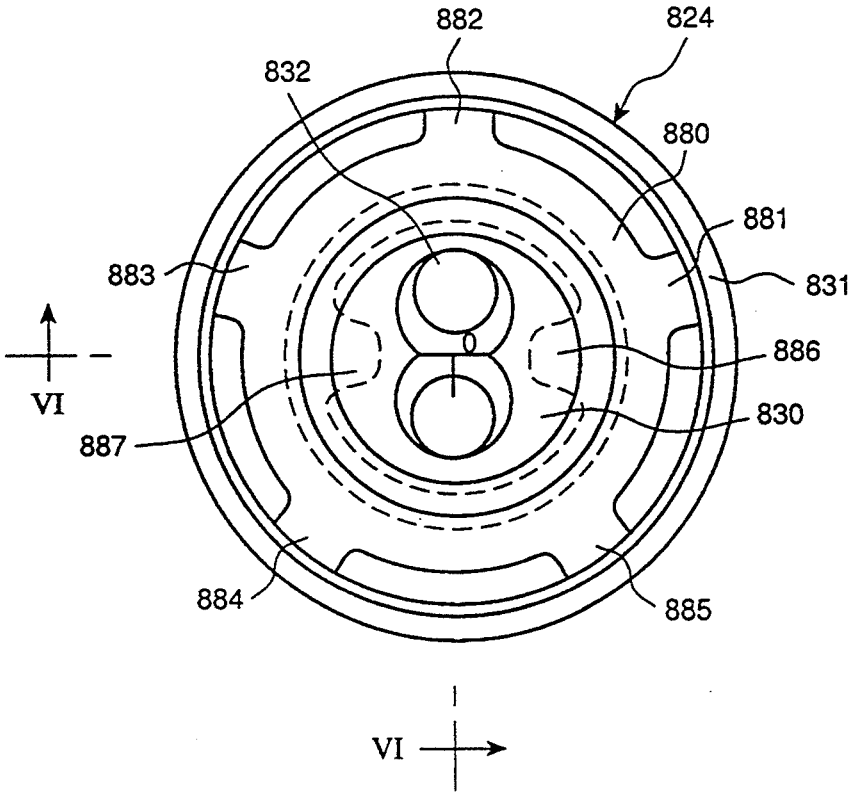
FIG. 26 is a top view of sleeve 824.
Figure 27:
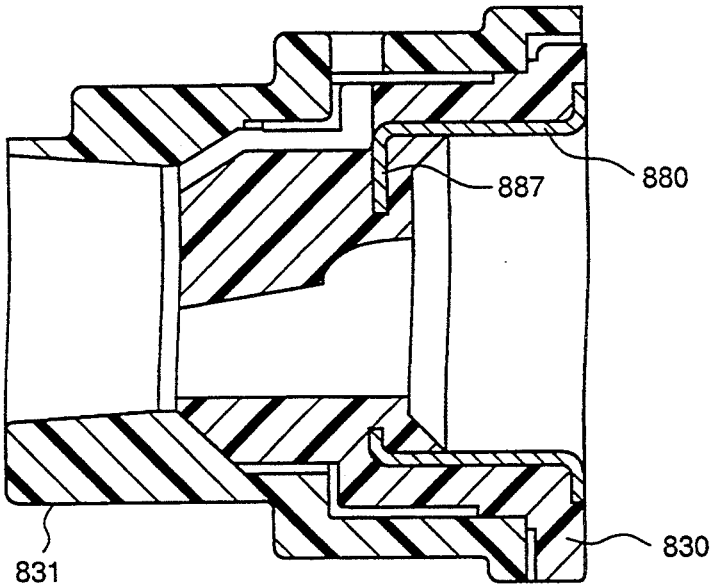
FIG. 27 is a sectional view of sleeve 824.

FIGS. 26 and 27 illustrate the sleeve 824 provided with the metallic ring 880. FIG. 26 is a top view of the sleeve 824, and FIG. 27 is a sectional view taken along the line VI-O-VI of FIG. 26.

The metallic ring 880 is molded securely on the inside of the sleeve nozzle 830, which is press-fitted to the nozzle body 810 of the fuel injection valve 801.

The sleeve 824, made by welding the cover nozzle 831 to the sleeve nozzle 830 on which the metallic ring 880 is molded, is press-fitted to the nozzle body 810. In consequence, the rotational torque between the sleeve nozzle 830 and nozzle body 810 is increased as compared to those of the above-described embodiments, making the sleeve 824 less rotatable relative to the fuel injection valve 801. Therefore, it is possible to prevent the sleeve 824 from rotating relative to the fuel injection valve 801, and to keep the fuel passages 832 and 833 directed toward the intake valves of the internal combustion engine, thereby to solve the problems such as abnormality in exhaust gas.

Since the metallic ring 880 is molded in the sleeve nozzle 830, trimming of burrs generated during forming of the metallic ring 880 by means of press working can be simplified or abolished. Therefore, the metallic ring 880 is formed at a lower cost.

Further, the claws 886 and 887 of the metallic ring 880 prevent the metallic ring 880 from coming-off from the sleeve nozzle 830, and the claws 881 to 885 prevent the metallic ring 880 from rotating in the sleeve nozzle 830.

The plate thickness of the metallic ring 880 should be such that the resin material of the sleeve 830 does not crack during the press-fitting of the fuel injection valve 801, preferably about 0.3 to 0.5 mm.

Figure 28:
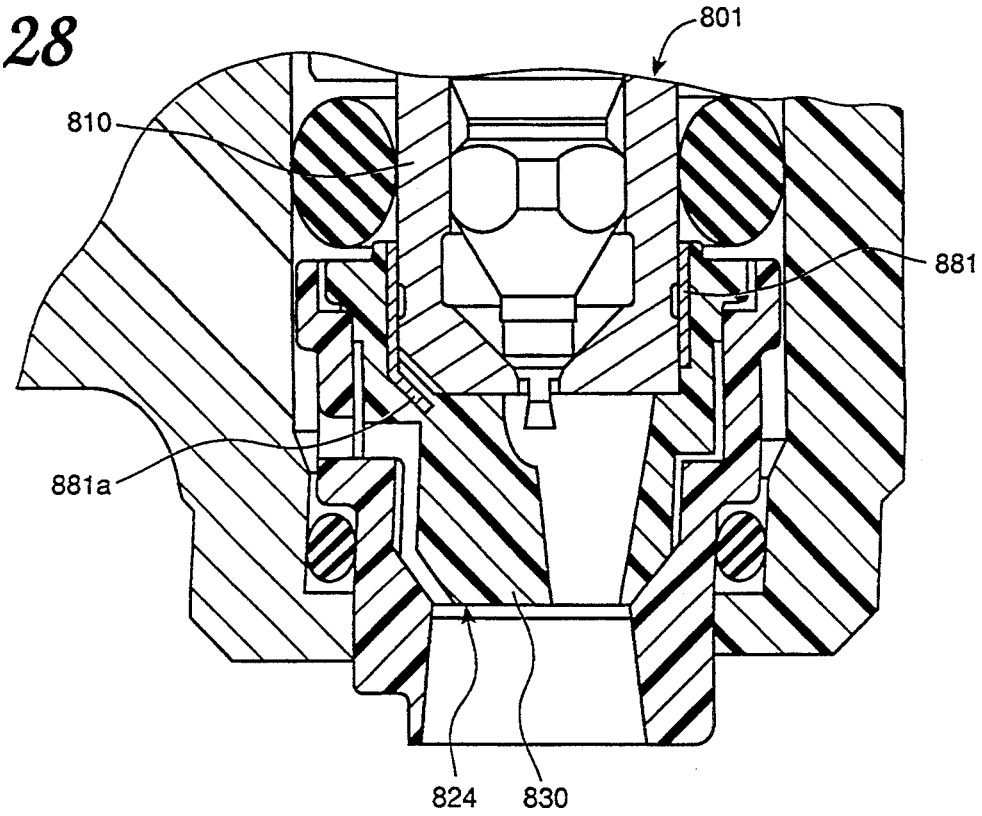
FIG. 28–30 are section views illustrating principal portions of the fuel injection values of the eighth, ninth, and tenth embodiments, respectively.
Figure 29:
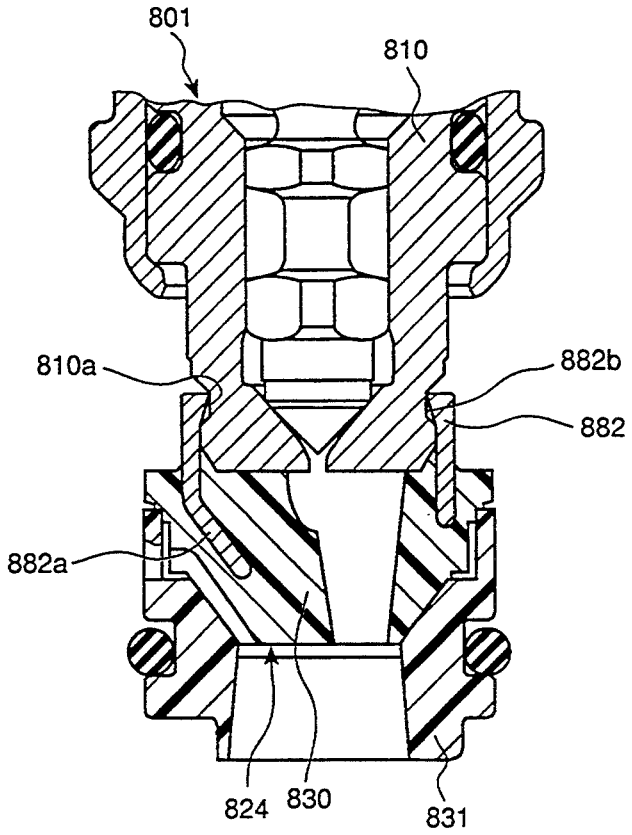
Figure 30:
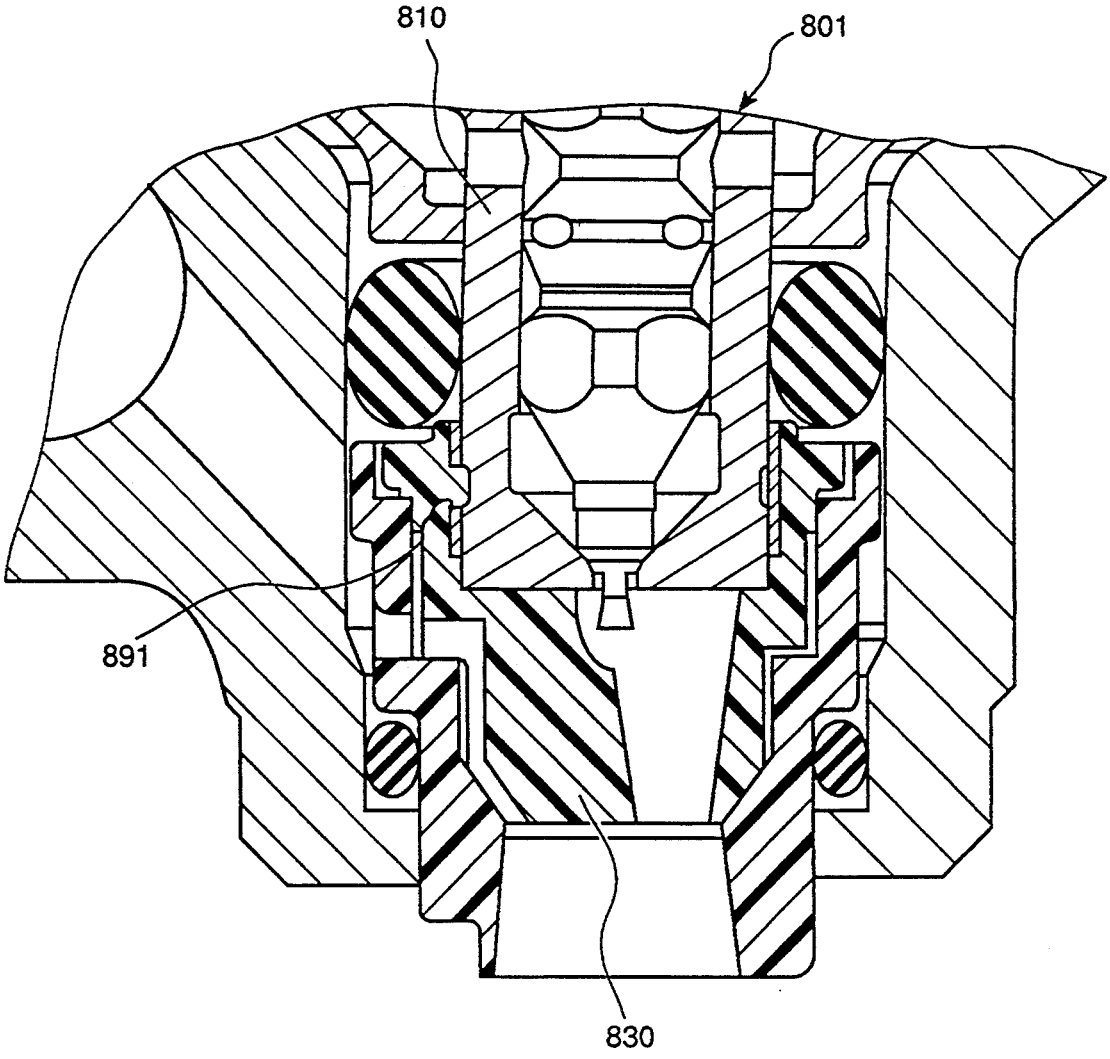

FIGS. 28, 29 and 30 are sectional views showing the principal portions of the fuel injection valves of the eighth, ninth and tenth embodiments, respectively. These embodiments, as well as the seventh embodiment, are to prevent the rotational torque between the sleeve 824 and the fuel injection valve 801 from decreasing.

In the eighth embodiment shown in FIG. 28, the metallic ring 881 provided with a bend 881*a* at one side of the bottom is molded securely to the press-fitted inner surface of sleeve nozzle 830. With this metallic ring 881, the rotational torque between the sleeve nozzle 830 and nozzle body 810 is increased as in the seventh embodiment, making the sleeve 824 less rotatable relative to the fuel injection valve 801. In addition, the bend 881*a* prevents the metallic ring 881 from coming-off from the sleeve nozzle 830.

In the ninth embodiment shown in FIG. 29, the press-fitting of the sleeve nozzle 830 to the nozzle body 810 is abolished, and the sleeve nozzle 830 is molded in such a manner that part of the metallic ring 882 is projected toward the sleeve nozzle 830. The projection 882*b* of the metallic ring 882 is formed to engage with the outer groove surface 810*a* of the nozzle body 810. The metallic ring 882 makes the sleeve 824 less rotatable relative to the fuel injection valve 801. In addition, as in the metallic ring 881 of the above-described eighth embodiment, the metallic ring 882 has a bend 882*a*, which prevents coming-off from the sleeve nozzle 830.

Next, in the tenth embodiment shown in FIG. 30, the metallic ring 883 with several holes 891 on the wall is molded into the sleeve nozzle 830, and this assembly is press-fitted to the nozzle body-810. In consequence, the resistance to rotational torque between the sleeve nozzle 830 and nozzle body 810 is increased. In addition, it is possible to prevent the metallic ring 883 from coming-off from the sleeve nozzle 830 or rotating in the sleeve nozzle 830 because resin flows into the holes 891 at the time of molding.

Figure 31:
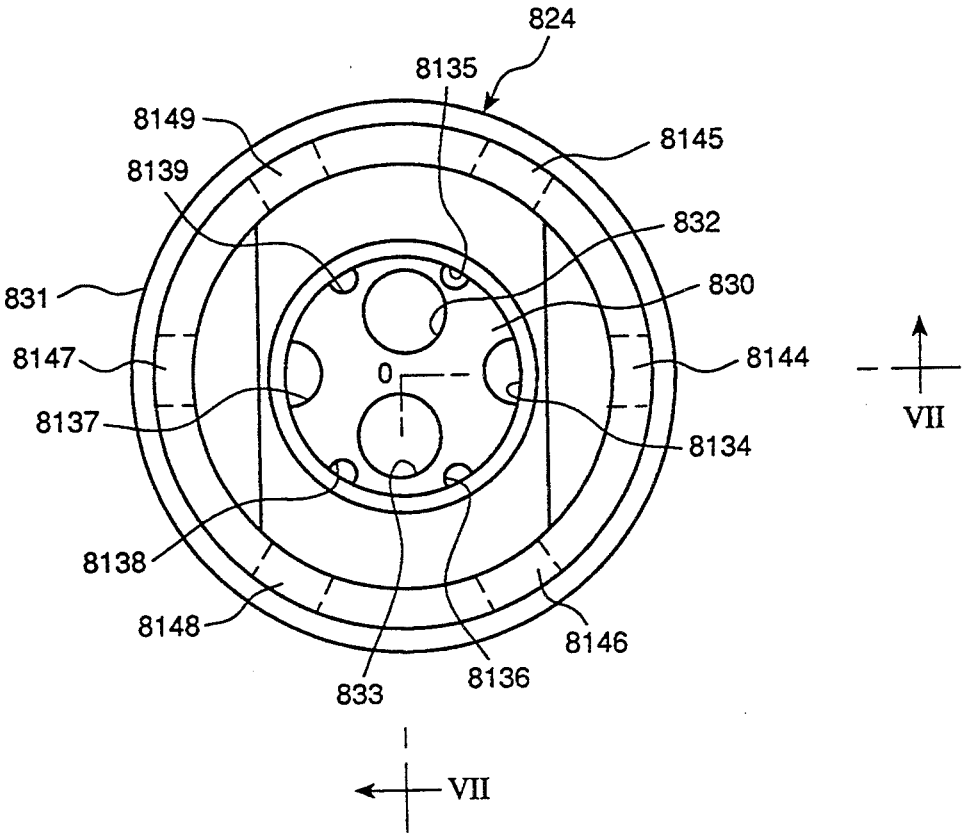
FIG. 31 is a bottom view of the sleeve of the eleventh embodiment of the present invention.
Figure 32:
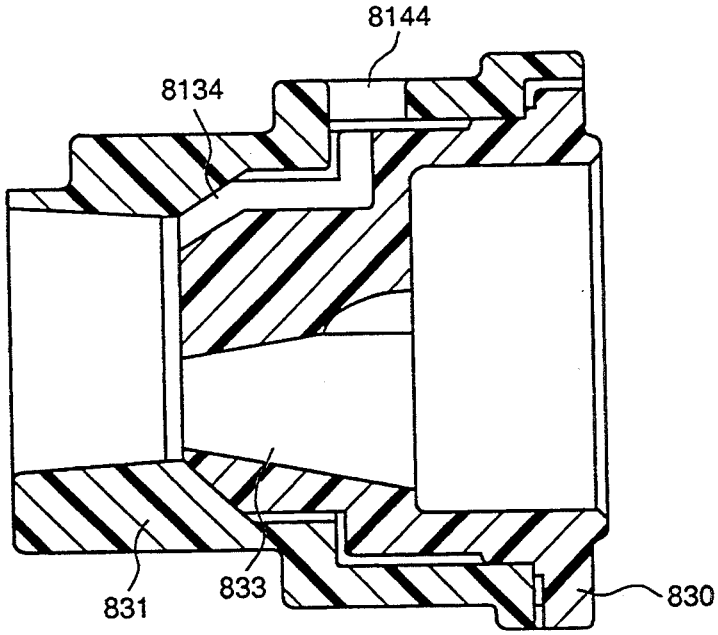
FIG. 32 is a sectional view taken along line VII-O-VII of FIG. 31.

FIGS. 31 and 32 show an eleventh embodiment of the present invention. FIG. 31 is a bottom view of the sleeve of the eleventh embodiment, and FIG. 32 is a sectional view taken along the line VII-O-VII of FIG. 31. As shown in FIG. 31, in this embodiment, six radial holes 8144 to 8149 penetrate the cylindrical wall of the cover nozzle 831. The outer wall of the sleeve nozzle 830 has grooves 8134 to 8139 which are connected with the penetrating holes 8144 to 8149 and serve as air passages.

Among these grooves 8134 to 8139, the grooves 8134 and 8137 are formed on the line which is perpendicular to the line connecting the centers of the fuel passages 832 and 833 and passes through the midpoint of the centers of these two holes, and are formed to have opening areas which are larger than those of other grooves.

The fuel injected through the fuel passages 832 and 833 is split by the large amount of air injected through the grooves 8134 and 8137 and, consequently, separated in two directions. Therefore, the spray is divided in two directions while being atomized. In consequence, the spray is introduced from the intake valves into the cylinder without adhering to the wall of the intake pipe in an engine with two intake valves.

In consequence, during startup of an engine, when assist air is introduced by the negative pressure in the intake pipe, the proportion of the spray obstructed by the intake port is reduced. Therefore, it is possible to control the emission of hydrocarbons (HC) caused by unburned fuel.

Figure 33:
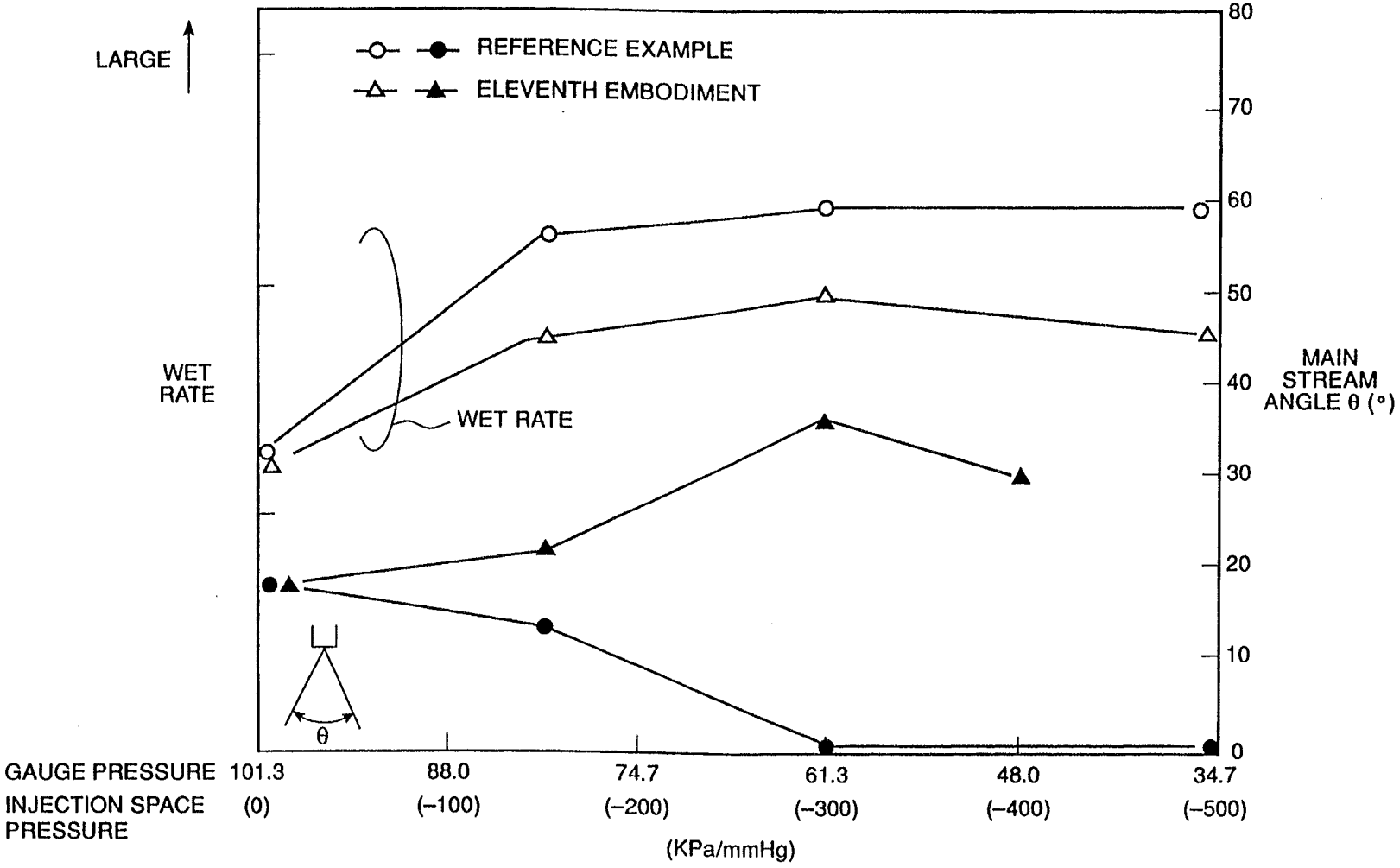
FIG. 33 is a graph illustrating the amount of fuel adhering to the intake pipe and the angle of the mainstream of the spray in relation to the injection space pressure.

The effect of this structure is described in FIG. 33. FIG. 33 is an illustration of characteristics showing the amount of the fuel adhering to the intake pipe (hereinafter, referred to as "wet rate") and the angle of the mainstream of the spray in relation to the injection space pressure. The spatial ratio of the grooves 8134 and 8137 with larger areas to other grooves 8135, 8136, 8138 and 8139 is set to 6:1. As a reference example, the sleeve in which the grooves used as assist air passages have identical opening areas as shown in FIG. 9 is assembled with the fuel injection valve 801.

As shown in the characteristics in FIG. 33, with the decrease in injection space pressure, in the sleeve of the reference example, the directivity of the spray is lost, and division into two directions of the spray cannot be attained at −300 mmHg.

However, in the sleeve of the eleventh embodiment, as compared to the above reference example, division of the spray in two directions is maintained. Therefore, the spray is divided in two directions during air assist, and directed toward the intake valve. As shown in FIG. 33, the wet rate of the intake port during air assist is reduced as compared to that of the reference example. Therefore, it is possible to control the emission of hydrocarbons (HC) caused by unburned fuel more strictly as described above.

We claim:

1. A fuel feed apparatus of an internal combustion engine, for supplying fuel to said internal combustion engine, comprising:

a fuel injection valve including a fuel injection nozzle body shaped generally cylindrically for intermittently supplying said fuel to be injected from a bottom end of said nozzle body;

a cover member made of a resin material and formed with a fuel passage and an assist air passage to said fuel passage, said cover member being fitted to an outer lower portion of said nozzle body so that assist air passing through said assist air passage collides with said fuel injected from said fuel injection valve; and a ring member made of metallic material and fixedly attached to said cover member, said ring member being in direct contact with an outer surface of said nozzle body and preventing positional displacement of said cover member from said nozzle body;

wherein said cover member comprises an outer member made of resin and an inner member made of resin and receiving said ring member at an inner surface thereof, said assist air passage being formed between said outer and inner members and guiding said assist air in a downward and inward direction.

2. A fuel feed apparatus according to claim 1, wherein said ring member is formed with a first claw extending inwardly at a bottom thereof and molded with said cover member to prevent said ring member from coming off said cover member.

3. A fuel feed apparatus according to claim 2, wherein said ring member is formed with a second claw extending outwardly at an upper portion thereof and molded with said cover member to prevent a rotation of said ring member relative to said cover member.

4. A fuel feed apparatus according to claim 2, wherein said nozzle body is provided with a groove at said outer surface of said nozzle body, and wherein said ring member is formed with a projection extending inwardly at an upper portion thereof to engage with said groove of said nozzle body.

5. A fuel feed apparatus according to claim 1, wherein said ring member is provided with a hole at a portion facing said outer surface of said nozzle body and said ring member is molded with said cover member so that said resin material fills said hole to prevent said ring member from coming off said cover member and to prevent said ring member from rotation with said cover member.

6. A fuel feed apparatus of an internal combustion engine, for supplying fuel to said internal combustion engine, comprising:

fuel injection valve including a fuel injection nozzle body shaped generally cylindrically for intermittently supplying said fuel to be injected from a bottom end of said nozzle body;

a cover member made of a resin material and formed with a fuel passage and an assist air passage to said fuel passage, said cover member being fitted to an outer lower portion of said nozzle body so that assist air passing through said assist air passage collides with said fuel injected from said fuel injection valve; and a ring member made of metallic material and fixedly attached to said cover member, said ring member being in direct contact with an outer surface of said nozzle body and preventing positional displacement of said cover member from said nozzle body, said ring member including projections that project radially with respect to said nozzle body and that are integral with said resin cover member so that rotation therebetween is prevented;

wherein said cover member comprises an outer member made of resin and an inner member made of resin and receiving said ring member at an inner surface thereof, said assist air passage being formed between said outer and inner members and guiding said assist air in a downward and inward direction.

* * * * *